US005884505A

United States Patent [19]

Shima

[11] Patent Number: 5,884,505

[45] Date of Patent: Mar. 23, 1999

[54] FLAT KNITTING MACHINE WITH LOOP PRESSERS AND A KNITTING METHOD WITH THE FLAT KNITTING MACHINE

[75] Inventor: Masahiro Shima, Wakayama, Japan

[73] Assignee: Shima Seiki Manufacturing, Ltd., Wakayma, Japan

[21] Appl. No.: 121,130

[22] Filed: Jul. 23, 1998

[30] Foreign Application Priority Data

Sep. 12, 1997 [JP] Japan ..... 9-248025
May 25, 1998 [JP] Japan ..... 10-142593

[51] Int. Cl.[6] ..... D04B 7/04

[52] U.S. Cl. ..... 66/64; 66/104

[58] Field of Search ..... 66/60 R, 64, 104, 66/106, 60 H, 61

[56] References Cited

U.S. PATENT DOCUMENTS 4,713,948 12/1987 Schmidt et al. ..... 66/106
5,408,849 4/1995 Schimko et al. ..... 66/106

FOREIGN PATENT DOCUMENTS 0 681 046A1 11/1995 European Pat. Off. .

*Primary Examiner*—Michael A. Neas
*Assistant Examiner*—Larry D. Worrell, Jr.
*Attorney, Agent, or Firm*—Nikaido Marmelstein, Murray & Oram LLP

[57] ABSTRACT

Stitch loops are securely pressed down and retained. The pressing and retaining position of the loop presser is properly adjusted according to the tension in the stitch loops. The loop presser 460 of a flat knitting machine is stored in a groove 445 of an auxiliary bed, and the loop retainer 462 is energized downward by an arm 465 and a cam 422. The loop retainer is swung downward by the cam 422 when it is advanced, and the retainer is swung back to the initial position when it is retracted. The top end of the loop retainer 462 is made to move forward to and over the opposing needle bed.

7 Claims, 19 Drawing Sheets

Fig.3-a
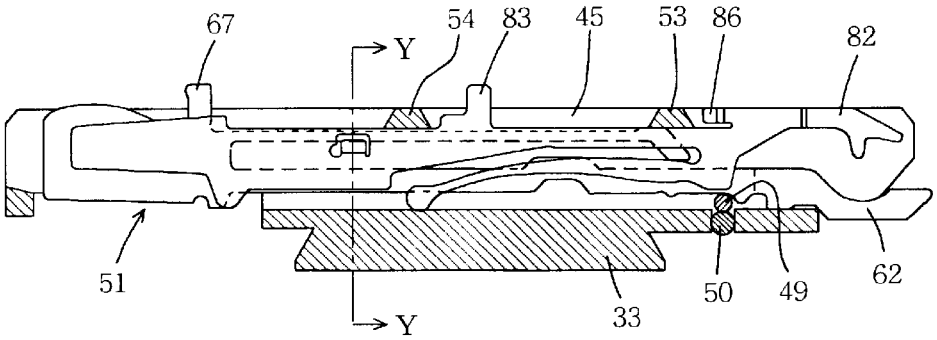
Fig.3-b
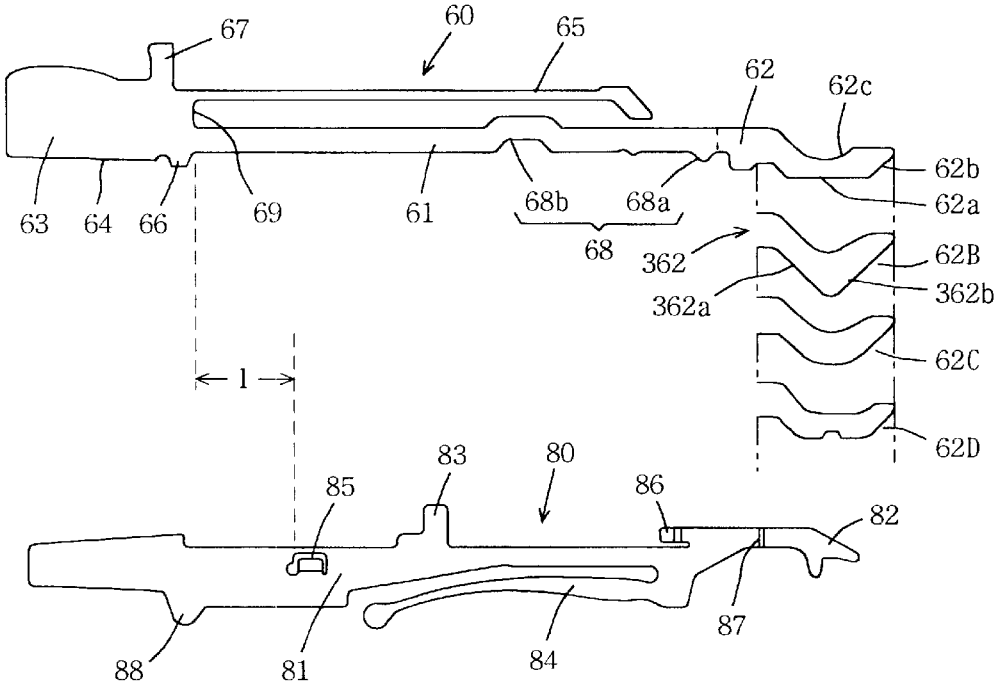
Fig.3-c
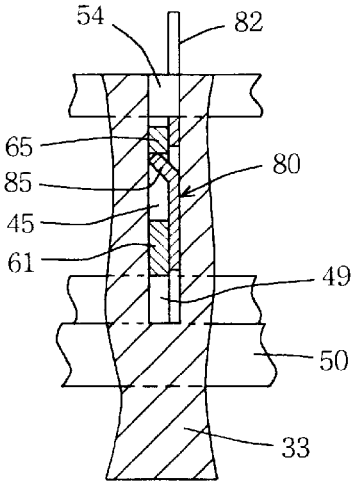

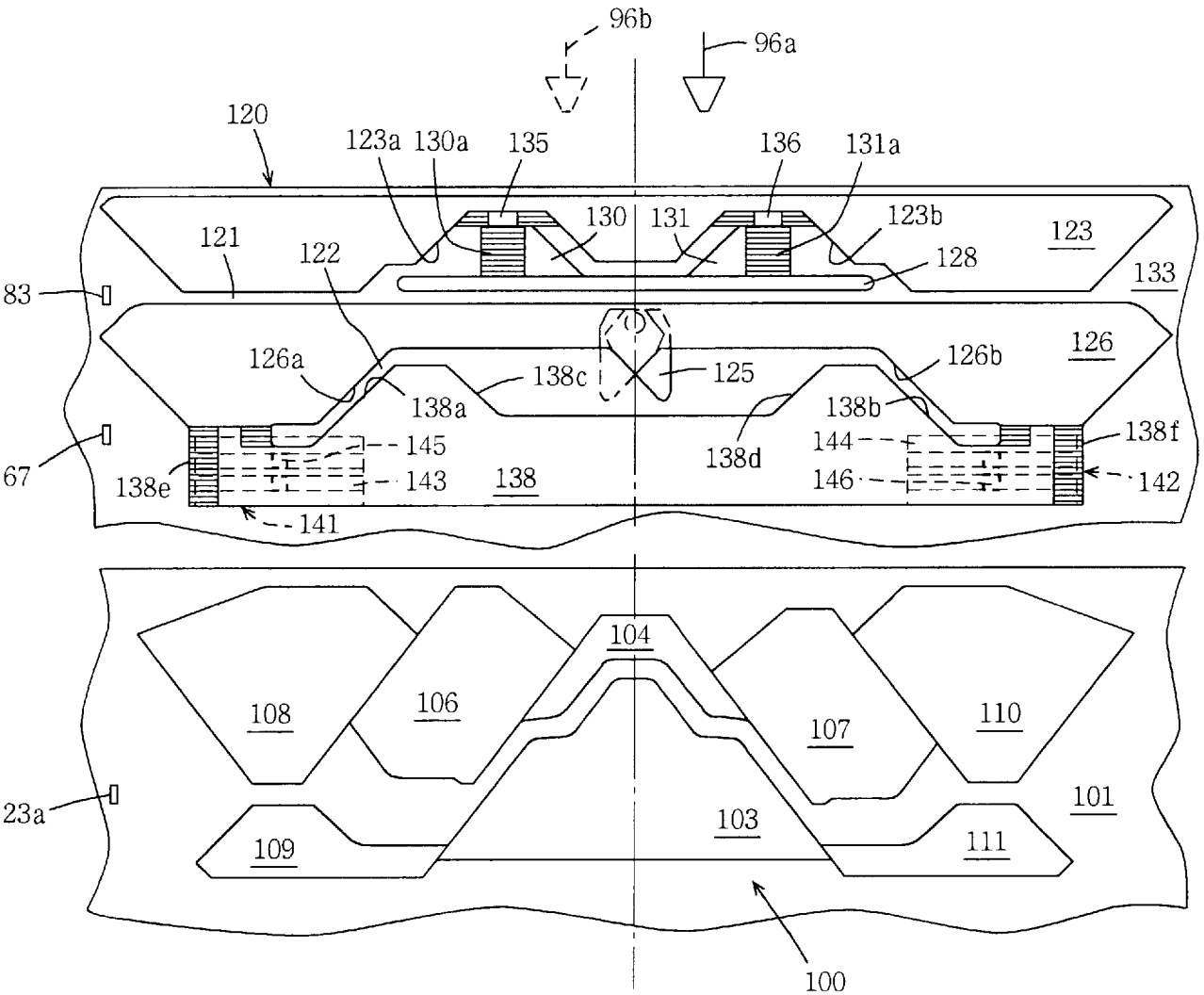
Fig.4-b
Fig.4-a

Fig.6-a
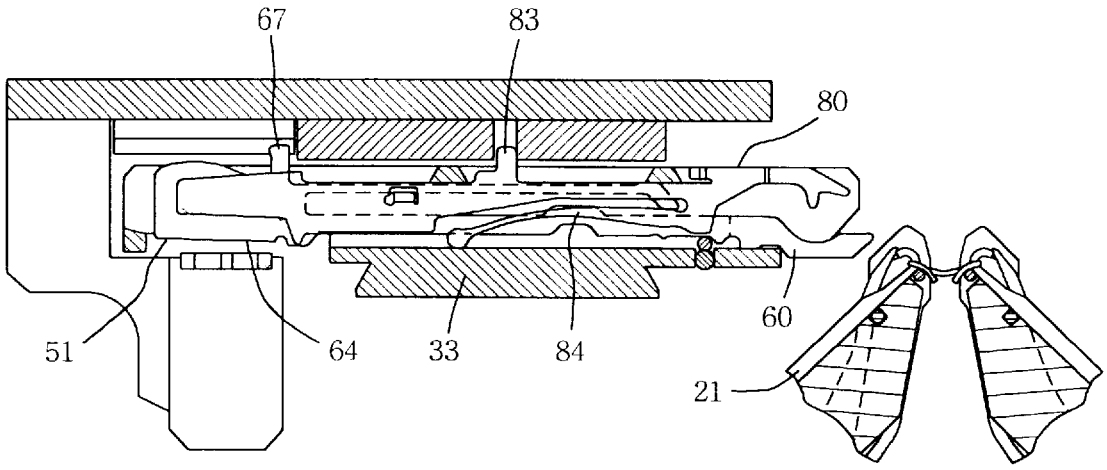
Fig.6-b
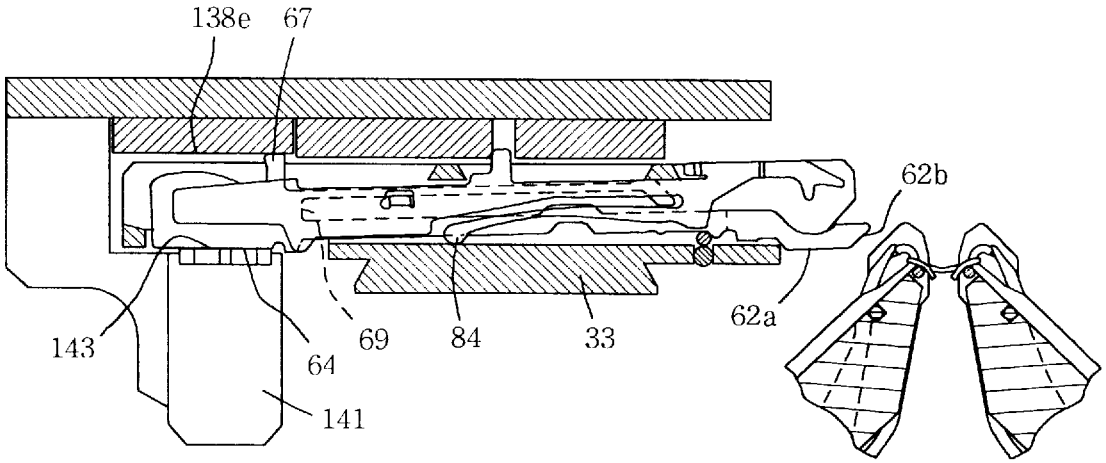
Fig.6-c
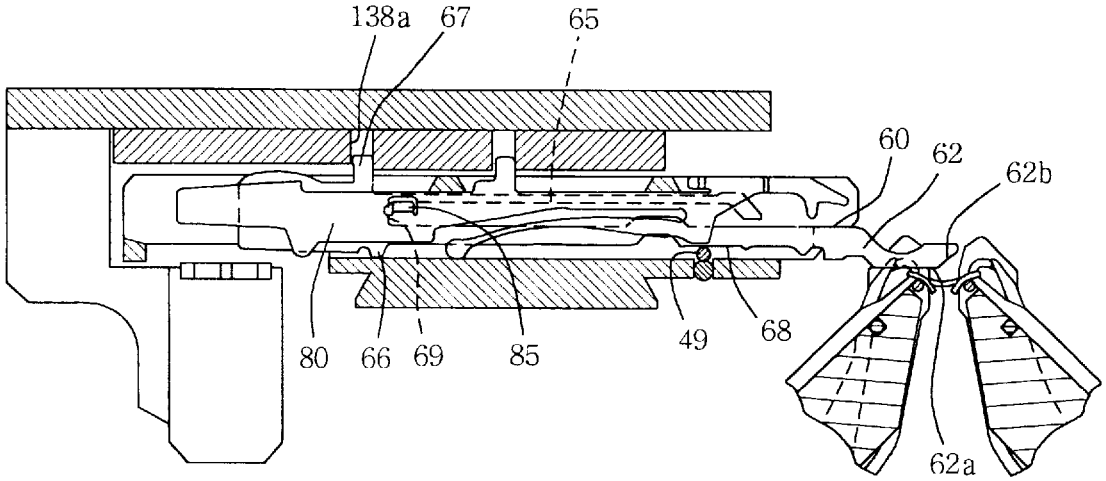

Fig.7-a
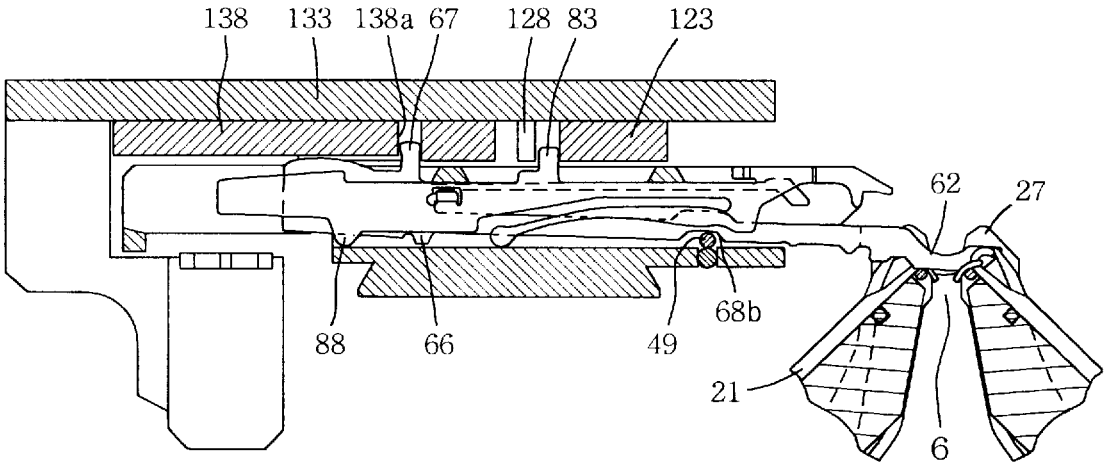
Fig.7-b
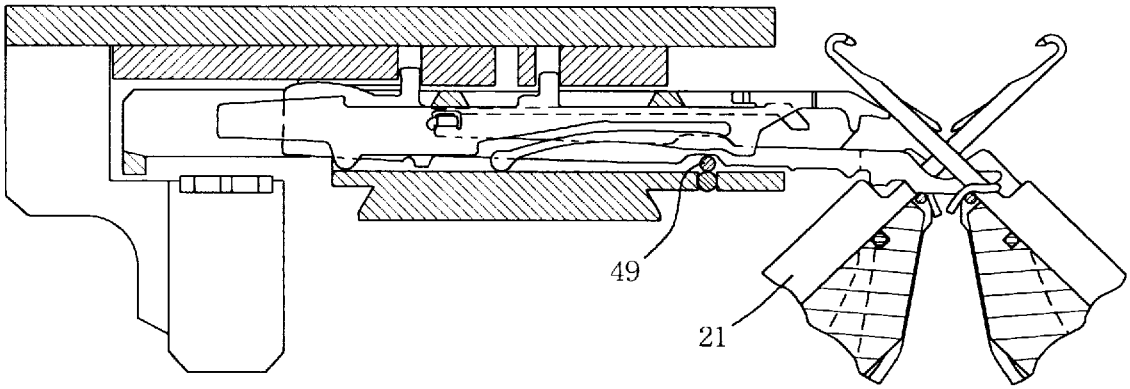
Fig.7-c
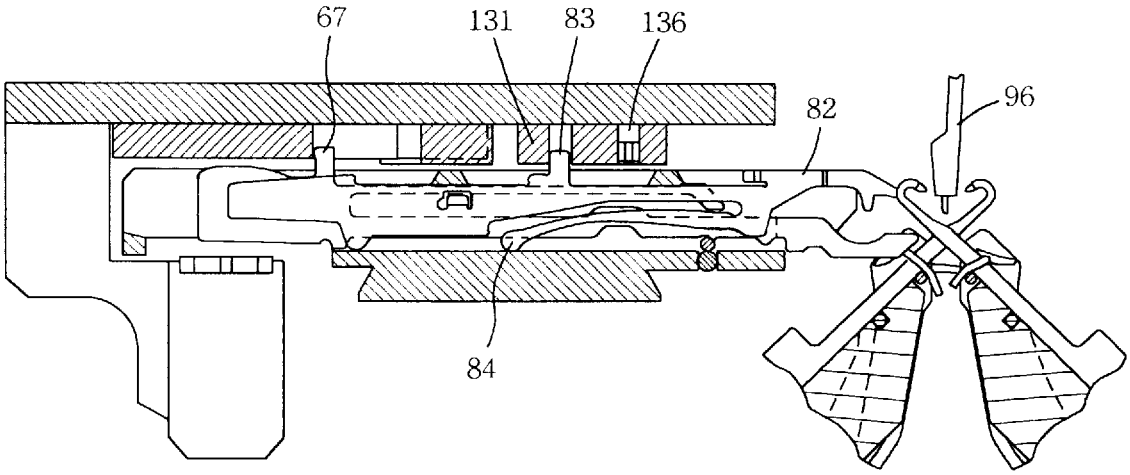

Fig.8-a
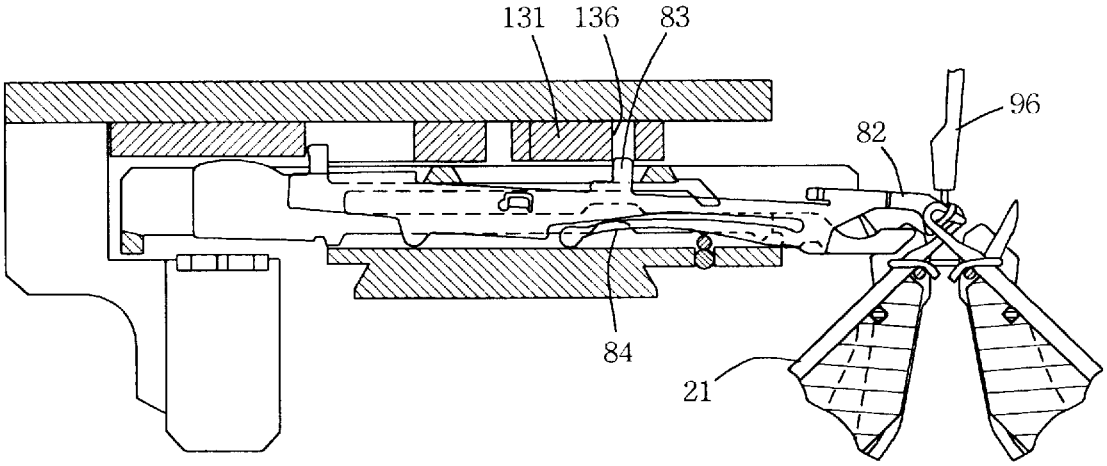
Fig.8-b
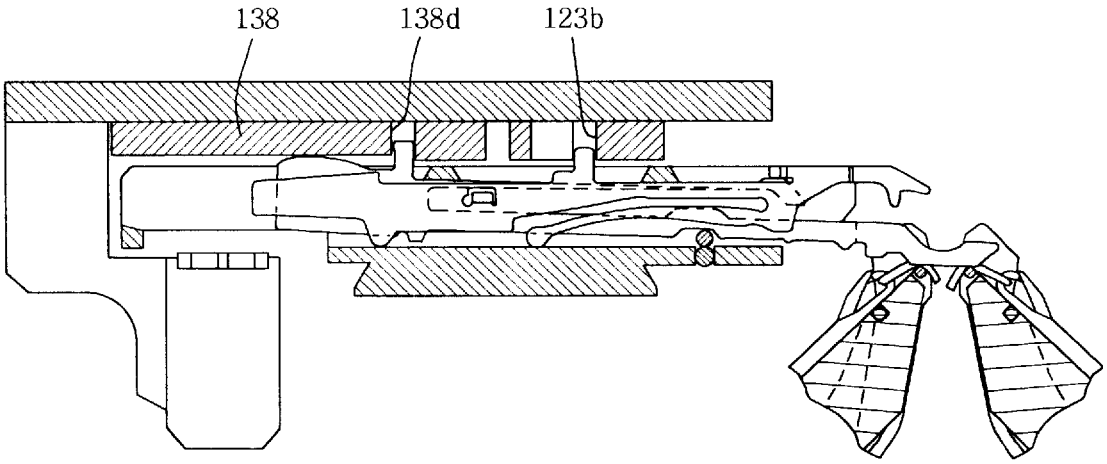
Fig.8-c
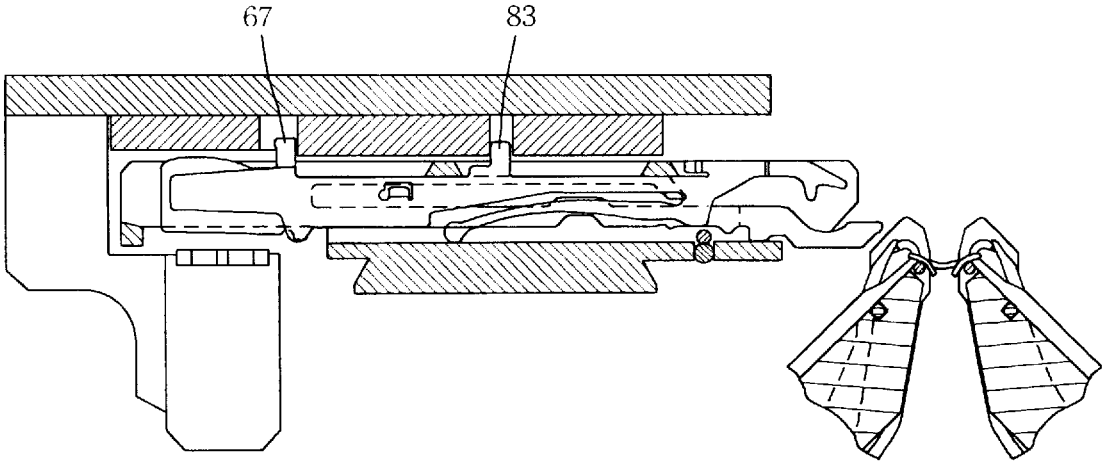

Fig.18-a
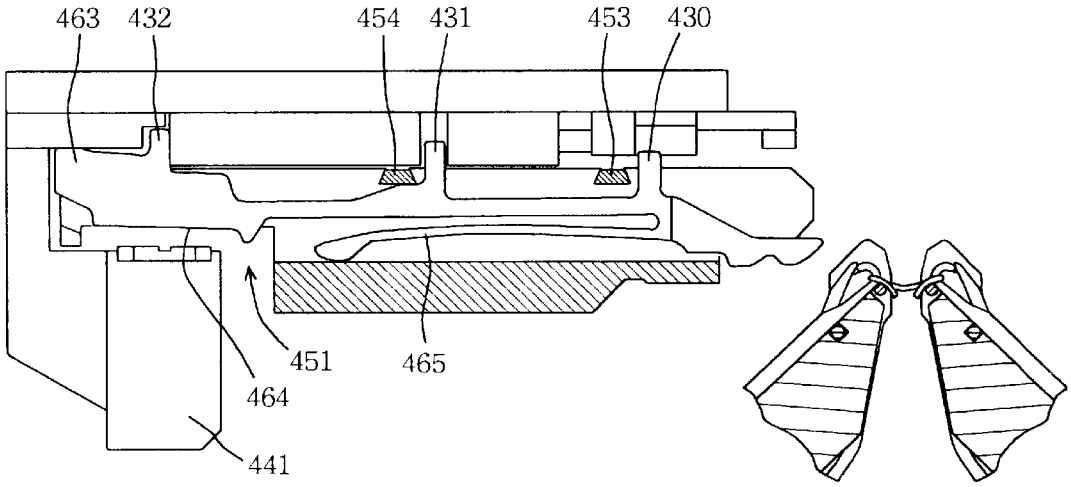
Fig.18-b
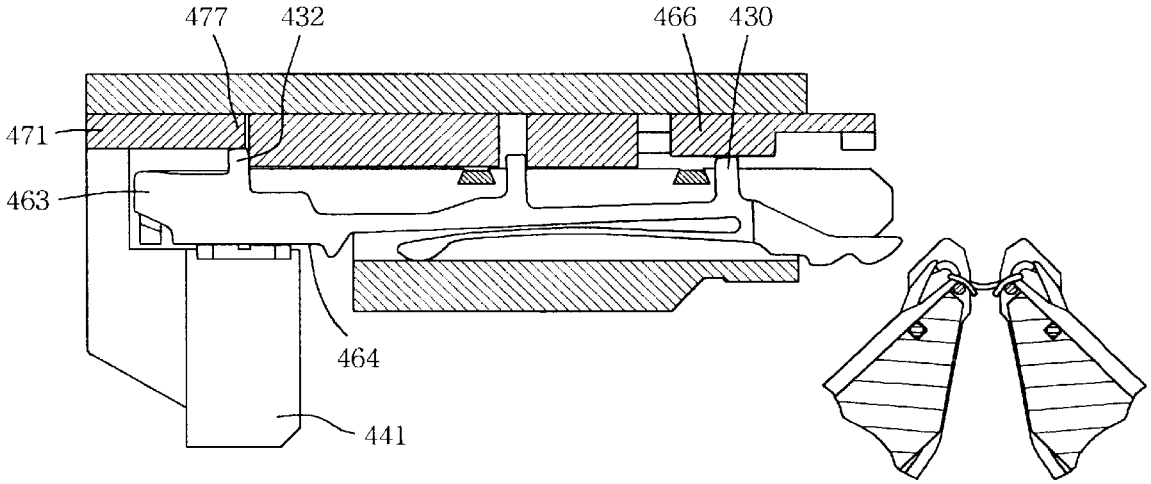
Fig.18-c
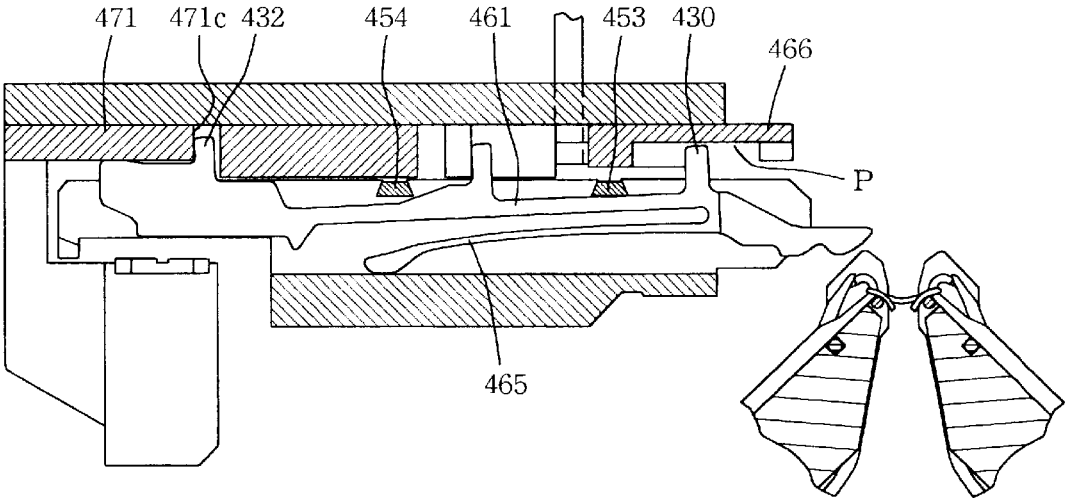

Fig.19-a
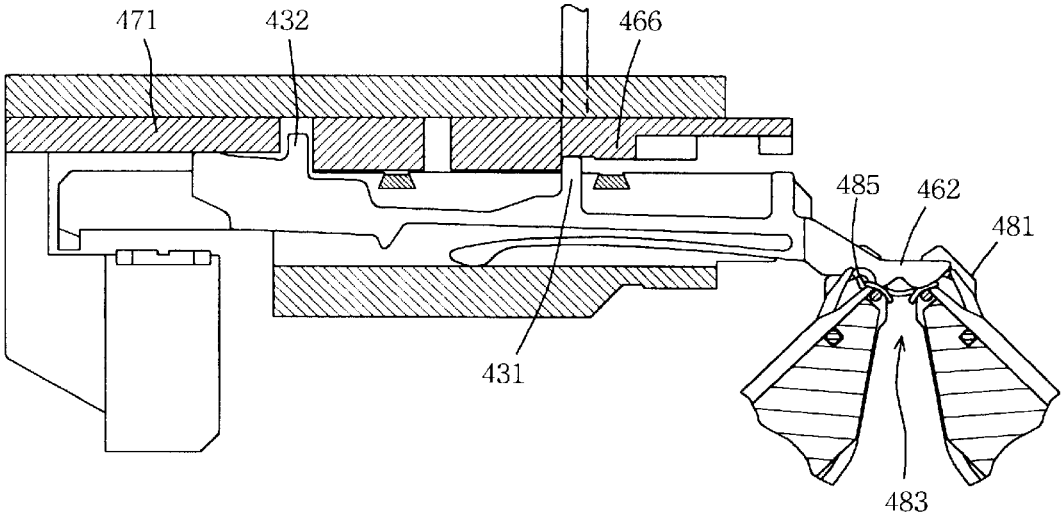
Fig.19-b
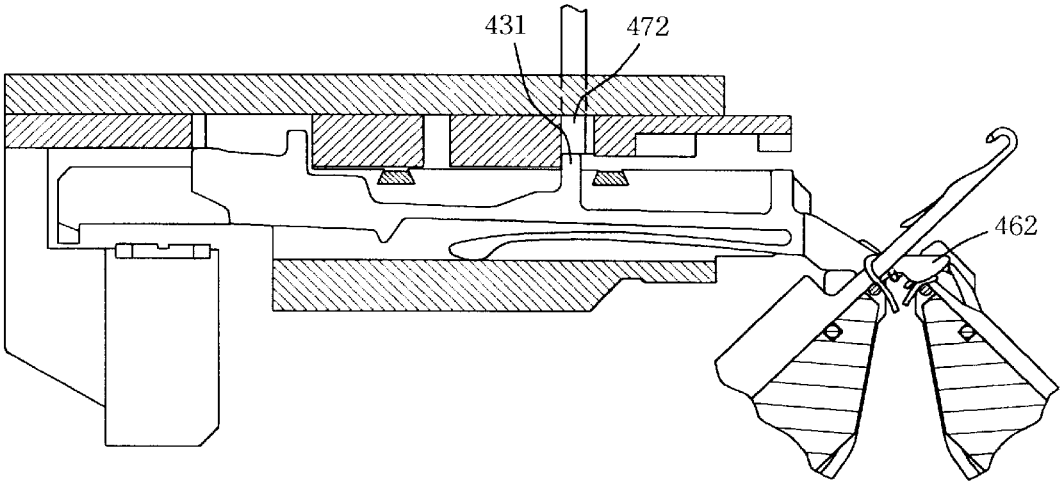
Fig.19-c
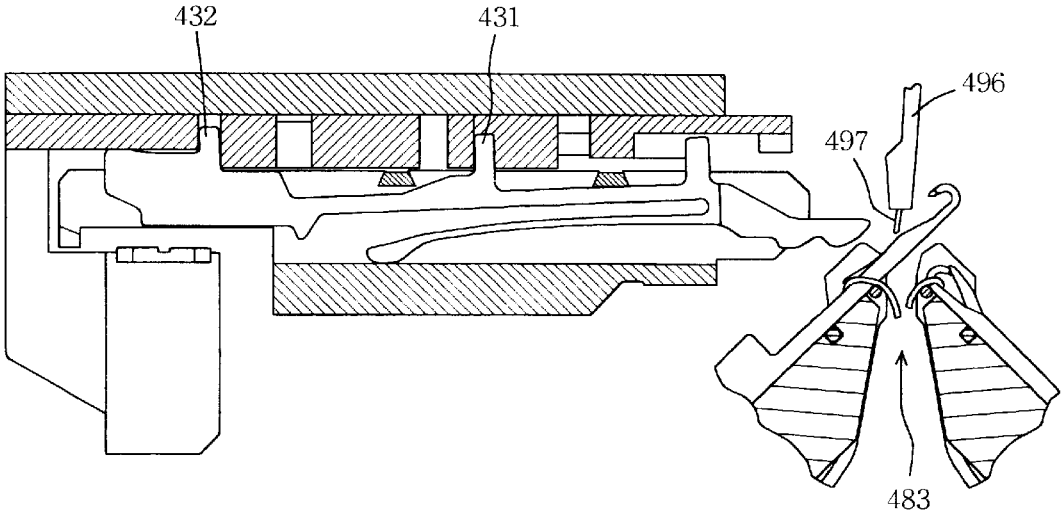

Fig.20-a
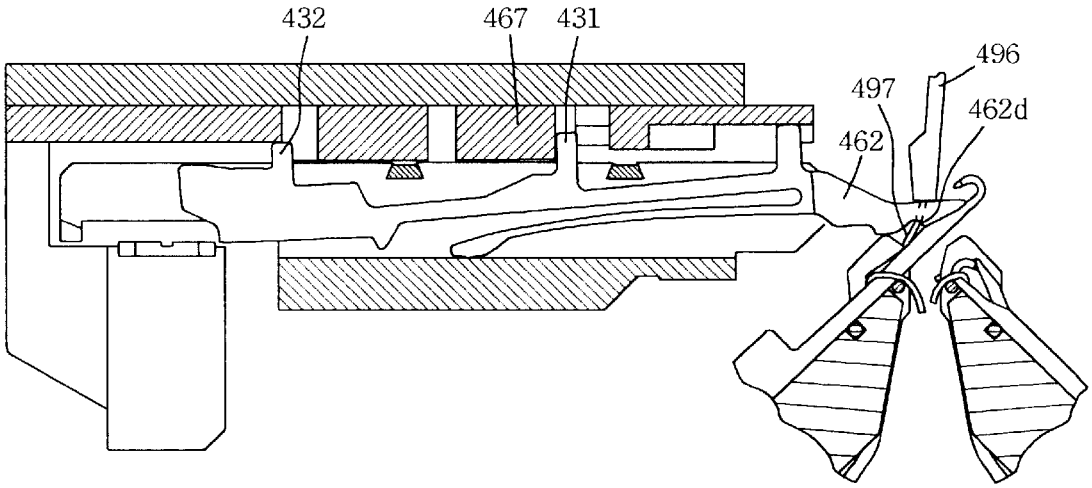
Fig.20-b
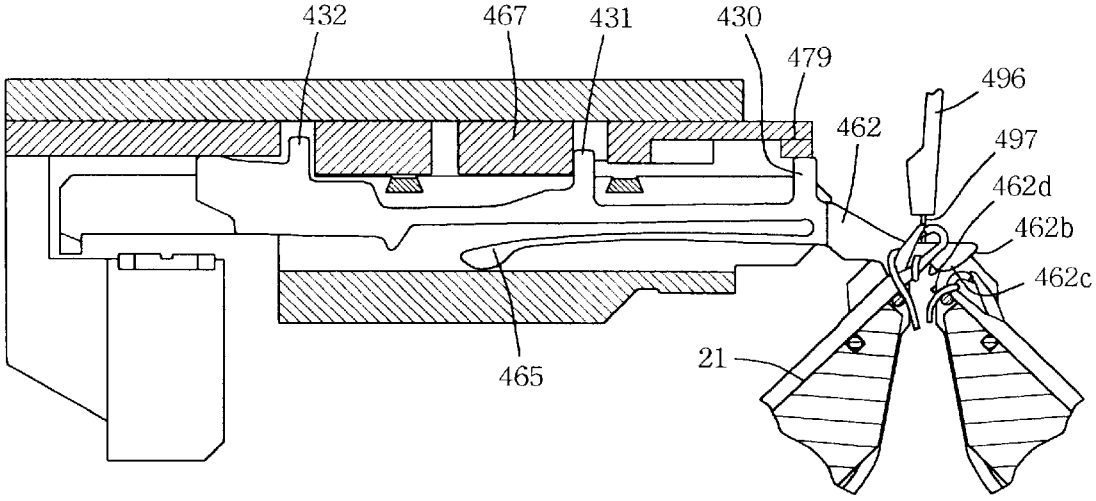
Fig.20-c
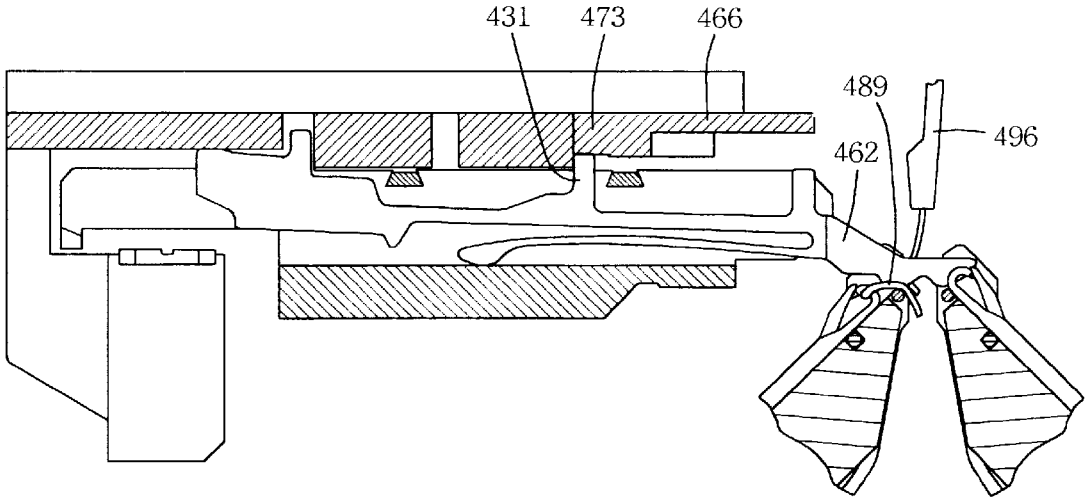

FLAT KNITTING MACHINE WITH LOOP PRESSERS AND A KNITTING METHOD WITH THE FLAT KNITTING MACHINE

FIELD OF THE INVENTION

The present invention relates to a flat knitting machine with loop pressers and a method for using the machine.

PRIOR ART

Loop pressing devices for a flat knitting machine include one described in Japanese Provisional Utility Model Hei 4-56787, European Patent Specification No. 0681046, etc. In this device, when, for example, a fabric of plain stitch is to be knitted by using needles of one bed only, a control butt of a loop presser, that is mounted on the needle bed on which plain stitch is done, is made to engage with a forward/backward movement cam provided on a carriage to advance the a loop retainer of the loop presser towards the center of the trick gap. As a result, the yarn stretching across adjacent needles is pressed down and retained by this loop presser. When a fabric is to be knitted by using both a front needle bed and a back needle bed, such as the case of rib stitch, loop pressers of both the front and back needle beds are made to advance to such positions that the top ends of both loop pressers cross with each other when seen from a side thereof to press down, with the loop retainers provided at the top ends of the loop pressers, and retain yarns stretching zigzag between the front and back needles.

In the above-mentioned loop pressing device, the amount of advancement of the loop presser in the trick gap is set in such a way that the loop retainer advances a little ahead of the center of the trick gap. Because of this, in the case of rib stitch, yarns stretching zigzag between needle beds can not be securely retained by the loop retainers. As a result, yarns of that portion may come out of a gap between a loop retainer and the opposing needle bed, posing a problem to knitting. Moreover, it is necessary to provide loop pressers on both the front and back needle beds.

Further, the loop retainers of the loop pressers are designed to be brought to the lowest position by the action of the forward/backward movement cams, irrespective of the level of tension in the stitch loop. This does not pose any problem to a fabric of which stitch loop tension is small, such as a fabric of which loop stitch size is relatively large. However, in case of a tightly-knit fabric of which stitch loop size is small, when the stitch loop is forced to be pressed down, the yarn may break or the fabric may be damaged. Moreover, every loop presser is actuated in the same manner when the carriage passes by, and every loop presser is made to move backward after the passage of the carriage. The loop pressing device was not designed to select and actuate necessary loop pressers according to the knitting width, design, etc. of a fabric to be knitted.

SUMMARY OF THE INVENTION

One objective of the present invention is to reliably press down and retain a stitch loop, and adjust the pressing down and retaining position of a loop presser to a proper position according to the level of tension in the stitch loop, so as to control the load onto the stitch loop.

Another objective of the present invention is to select only required loop pressers out of a large number of loop pressers to make them involve in knitting of a fabric.

Another objective of the present invention is to provide a compact loop pressing device with which it is sufficient, for example, to use one auxiliary bed of loop pressers for two needle beds.

Other objectives of the present invention will be clarified by the following description.

A flat knitting machine that is provided with loop pressers according to the present invention is a flat knitting machine comprising:

at least a pair of needle beds, one in a front and an other in a back, facing against each other with a trick gap in between and having a large number of needles arranged to be moved freely forward and backward and having a large number of sinkers arranged between needles;

an auxiliary bed supporting a large number of loop pressers so that the pressers can be moved freely forward to and backward from said trick gap and provided above at least one of said needle beds;

wherein said needles and loop pressers are moved forward to and backward from said trick gap by cam engagement with forward/backward movement cams provided on a carriage reciprocating over said needle bed, said flat knitting machine being characterized in that said loop presser has a shank, a loop retainer provided at a top end of the shank, forward/backward movement controls provided on a upper edge of the shank, and an arm branching and extending from the shank, and a length of said loop retainer is made longer than a width of the trick gap, said auxiliary bed is provided with a groove for holding the loop presser, and the arm or the shank of the loop presser is compressed and deformed for swingably containing the loop presser in the groove, the loop retainer of the loop presser is made by said forward/backward movement cam to advance over an opposing needle bed, and a swing locus control means is provided for swinging said loop retainer when said loop presser is moved forward/backward.

Preferably, said carriage is provided with a selection means for selecting a loop presser for being cam-engaged with said forward/backward movement cam.

Preferably, said swing locus control means is arranged so that during the forward movement of the loop presser, the loop retainer is swung downward by a repulsive force according to said compressive deformation, and during the backward movement of the loop presser, the loop retainer is swung back to a original position against said repulsive force.

Preferably, the loop retainer is energized upward by the repulsive force according to compressive deformation of said loop presser, and the loop retainer is made to swing downward, in the advanced position of the loop presser, by said swing locus control means against said upward energization.

Preferably, said selection means comprises a selection part at a rear part of the loop presser and is swingably energized upward, a pressing cam provided in a position on the carriage corresponding to said selection part, and an actuator provided with an attractive part being able to attract and release, an upper edge of the selection part is pressed by said pressing cam for making the selection part swing downward for making a lower edge of said selection part contact the attractive part of said actuator and be attracted and held, and the selection part of the loop presser selected is released from the attraction by said attractive part for swinging said shank upward and making said forward/backward movement control part cam-engage with the forward/backward movement cam of said carriage.

Preferably, said loop presser is also a yarn guide.

According to the present invention, the loop retainer advances to and over the opposing needle bed. It, therefore, is sufficient, for example, for a pair of needle beds, to provide one auxiliary bed of loop pressers. Hence the resulting loop pressing device is compact. Moreover, as the loop retainer advances to and over the opposing needle bed, the loop retainer can reliably press down and retain prolongations between stitches in rib knitting, etc.

According to the present invention, the loop retainer's force for pressing down and retaining a stitch loop is related to both the repulsive force due to compressive deformation of the arm or the shank of the loop presser and the force exerted by the swing locus control means. As a result, the depth of the loop retainer's movement for pressing down the loop varies according to the tension in the prolongations, and the loop can be pressed down and retained adequately. This reduces the burden on the stitch loops.

Moreover, according to the present invention, out of a large number of loop pressers, only the required loop pressers can be made to cam-engage with the forward/backward movement cam. This is related to reversing the carriage over needles of a needle bed. When the engagement between a loop presser and the forward/backward movement cam is undone at the selector, even if the carriage is present over needles of the needle bed, the loop presser will be retracted, and needle beds can be racked relative to each other. Furthermore, it is possible to prevent conventional useless pressing down and retaining of any stitch loop that is held on an inactive needle.

In the knitting method according to the present invention, a knitting method using a flat knitting machine comprising:

at least a pair of needle beds, one in a front and an other in a back, facing against each other with a trick gap in between, and a large number of needles, arranged to be moved freely forward and backward in said needle beds and a large number of sinkers arranged between needles in said needle beds, and a yarn feeder above the trick gap for feeding yarn to said needles;

an auxiliary bed supporting a large number of loop pressers so that the pressers can be moved freely forward to and backward from said trick gap positioned above at least one of said needle beds;

a carriage reciprocating over said needle beds, and provided with a selecting means for selecting a loop presser being to be cam-engaged said forward/backward movement cams;

wherein said needles and loop pressers are moved forward to and backward from said trick gap by said cam engagement with said forward/backward movement cams provided on the carriage, wherein said loop presser has a shank, a loop retainer provided at a top end of the shank, forward/backward movement controls provided on a upper edge of the shank, and an arm branching and extending from the shank, and a length of said loop retainer is made longer than a width of the trick gap, wherein said auxiliary bed is provided with a groove for holding a loop presser, and the arm or the shank of the loop presser is compressed and deformed for swingably containing the loop presser in the groove, wherein the loop retainer of the loop presser is made by said forward/backward movement cam to advance toward and over an opposing needle bed when seen from above, and wherein a swing locus control means is provided for swinging said loop retainer when said loop presser is moved forward/backward, and comprising:

shifting said yarn feeder beyond a knitting width of a knitted fabric and knitting a first stitch course, after that, before knitting a second stitch course, making a loop presser located immediately outside of a first stitch loop of said second stitch course move forward into the trick gap for pressing down and retaining a yarn extending from said first stitch course to the yarn feeder by the loop retainer of said advanced loop presser;

after that, shifting said yarn feeder above said knitting width for winding said yarn around said loop retainer; and next, after forming at least the first stitch loop of said second stitch course, making said loop presser move backward from the trick gap and releasing said yarn from said loop retainer.

In this way, the stitch loop at one end of a fabric can be stabilized by a loop presser, and loop stitches can be used to increase a knitting width or a pattern width. As a result, a fabric with a higher value added can be knitted.

BRIEF DESCRIPTION OF THE ATTACHED DRAWINGS

FIG. 3*a,b* and *c* shows a loop presser and a yarn guide.

Figure 1:
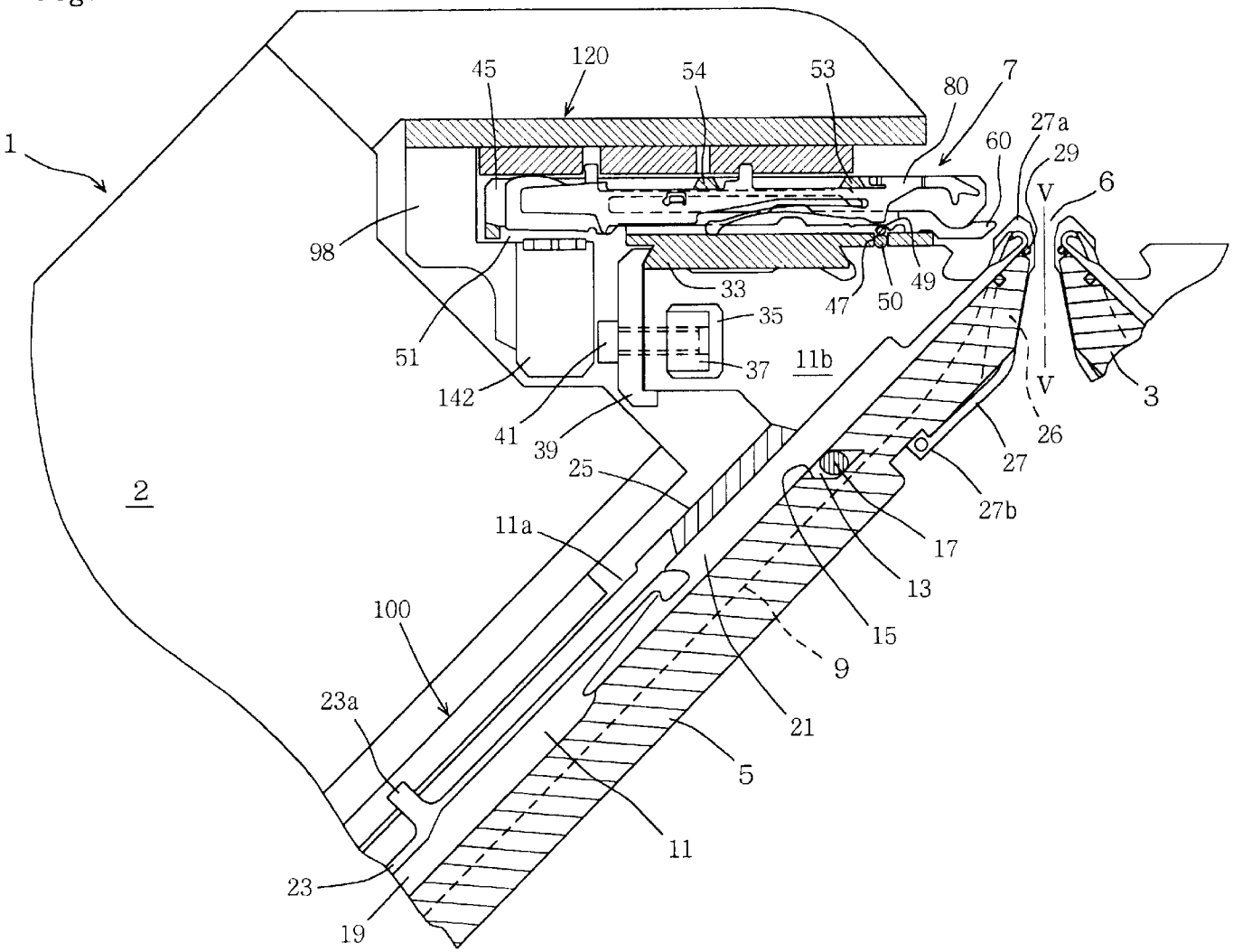
FIG. 1 is a sectional view of a part of a flat knitting machine of an embodiment of the present invention.

FIG. 3-*a* is a partial enlarged sectional view of the auxiliary bed of FIG. 1.

FIG. 3-*b* shows the loop presser and the yarn guide seen from a side.

FIG. 3-*c* is a sectional view along the line Y—Y of FIG. 3-*a*.

FIG. 4*a* and *b* show forward/backward movement cams for needles, yarn guides and loop pressers.

FIG. 4-*a* is a perspective view of the forward/backward movement cam for needles.

FIG. 4-*b* is a perspective view of the forward/backward movement cam for loop pressers and yarn guides.

Figure 5:
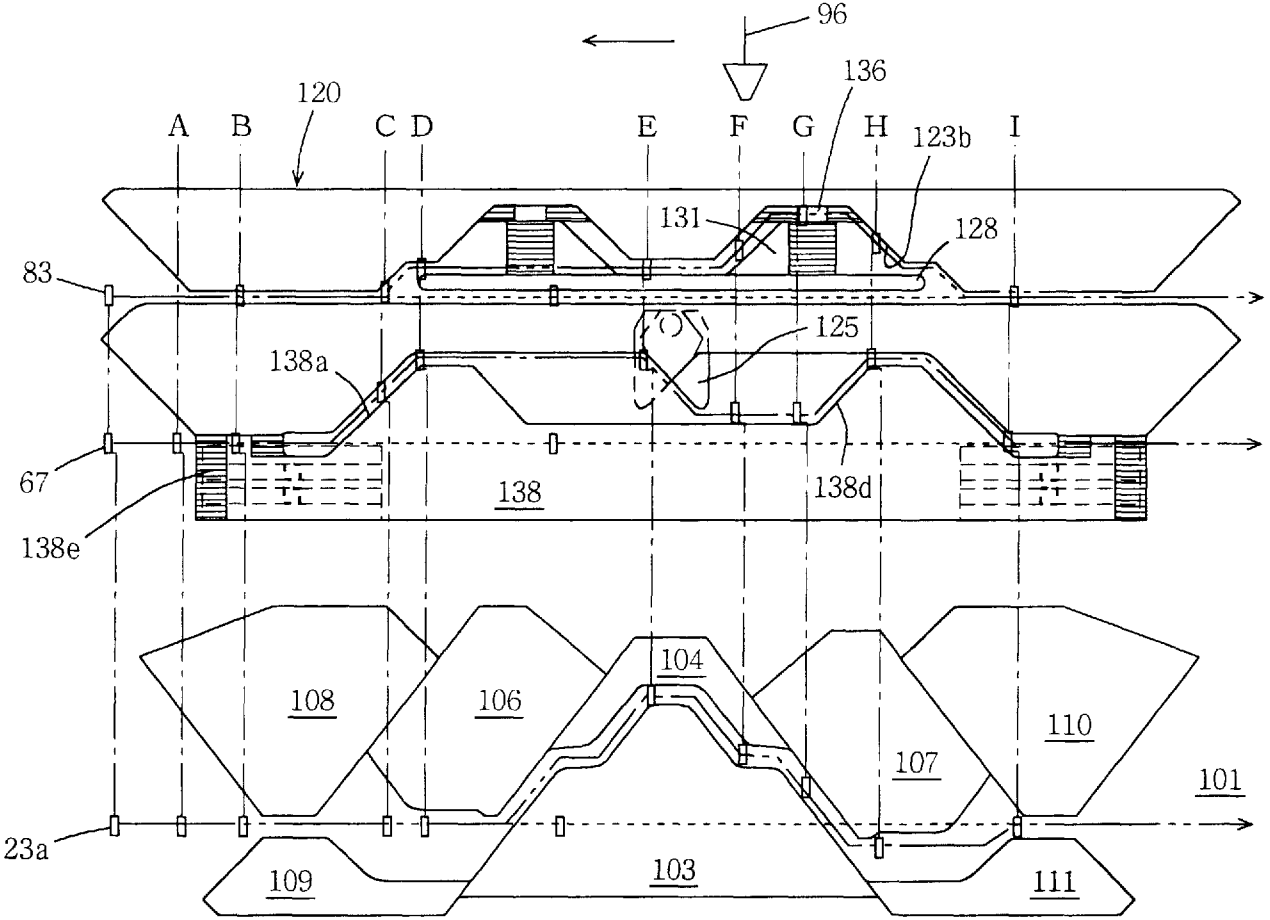

FIG. 5 is a diagram showing the loci of the respective butts of the needle, yarn guide and loop presser when the carriage travels to the left.

FIG. 6*a,b* and *c* is sectional views showing the states near the trick gap of the flat knitting machine at the positions A through C in FIG. 5.

FIG. 6-*a* shows the state near the trick gap of the flat knitting machine at the position A of FIG. 5.

FIG. 6-*b* shows the state near the trick gap of the flat knitting machine at the position B of FIG. 5.

FIG. 6-*c* shows the state near the trick gap of the flat knitting machine at the position C of FIG. 5.

FIG. 7*a,b* and *c* is sectional views showing the states near the trick gap of the flat knitting machine at the positions D through F in FIG. 5.

FIG. 7-*a* shows the state near the trick gap of the flat knitting machine at the position D of FIG. 5.

FIG. 7-*b* shows the state near the trick gap of the flat knitting machine at the position E of FIG. 5.

FIG. 7-*c* shows the state near the trick gap of the flat knitting machine at the position F of FIG. 5.

FIG. 8*a,b* and *c* is sectional views showing the states near the trick gap of the flat knitting machine at the positions G through I in FIG. 5.

FIG. 8-*a* shows the state near the trick gap of the flat knitting machine at the position G of FIG. 5.

FIG. 8-*b* shows the state near the trick gap of the flat knitting machine at the position H of FIG. 5.

FIG. 8-*c* shows the state near the trick gap of the flat knitting machine at the position I of FIG. 5.

Figure 9:
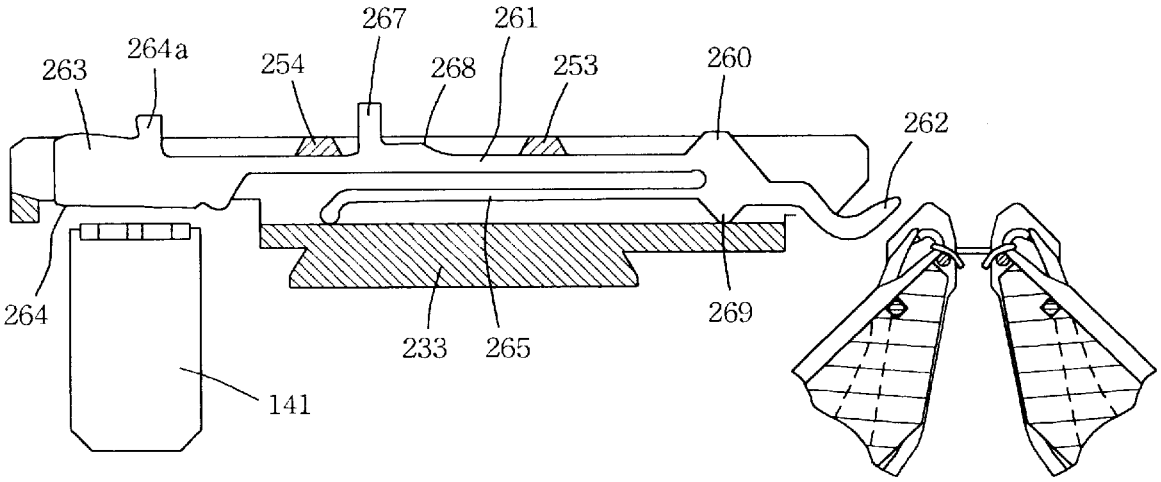

FIG. 9 shows a modification of the loop presser, and the loop presser is in its initial position.

Figure 10:
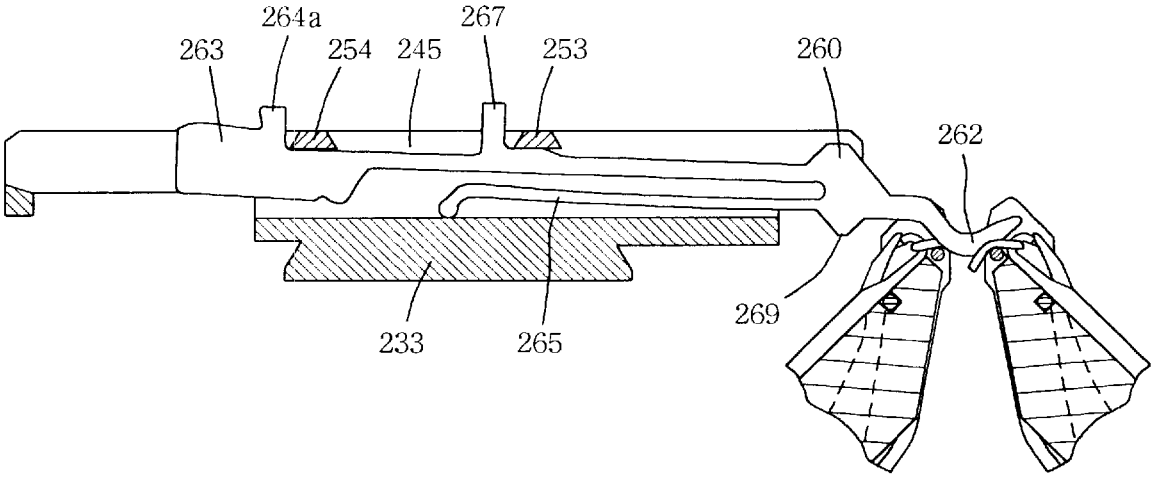

FIG. 10 shows the modification of the loop presser, and the loop presser is moved forward.

Figure 11:
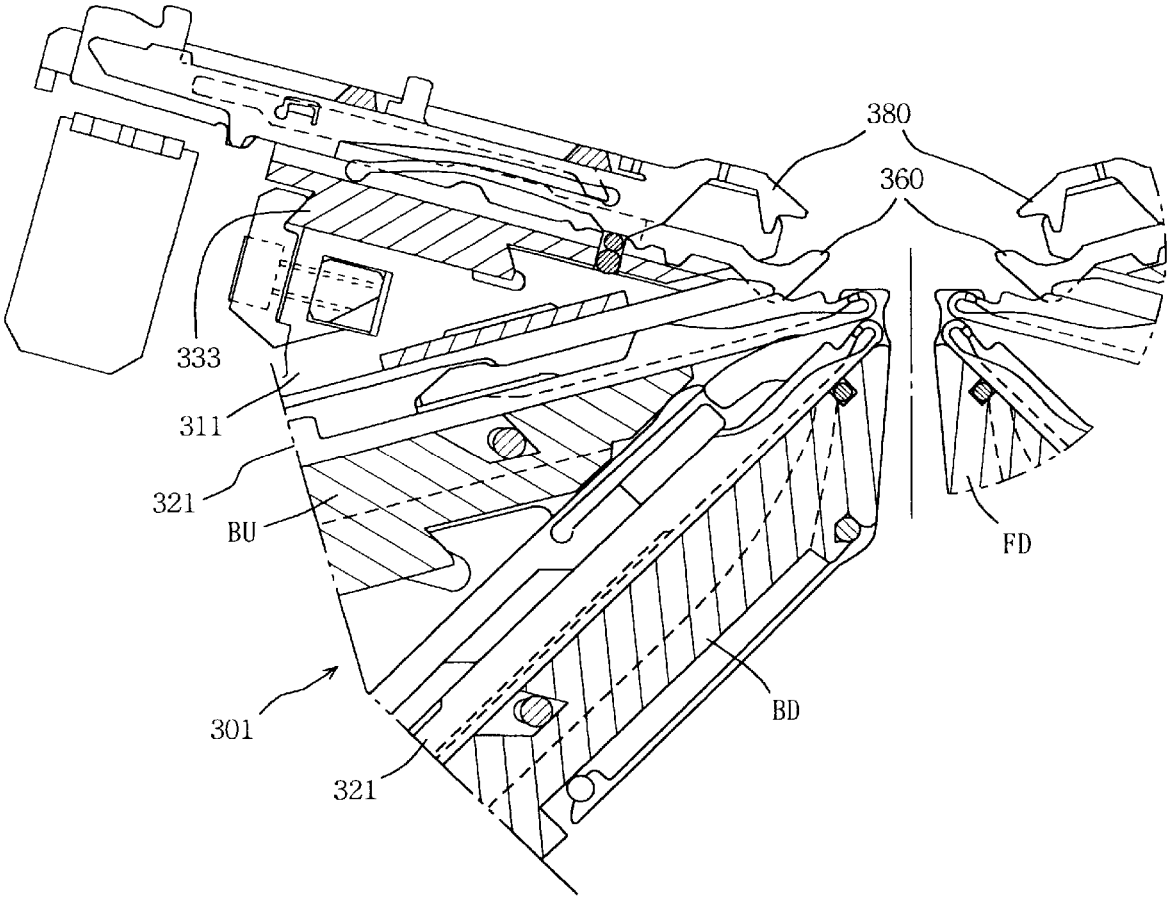

FIG. 11 shows a modification wherein the loop presser of the embodiment is applied to a flat knitting machine with four needle beds.

Figure 12:
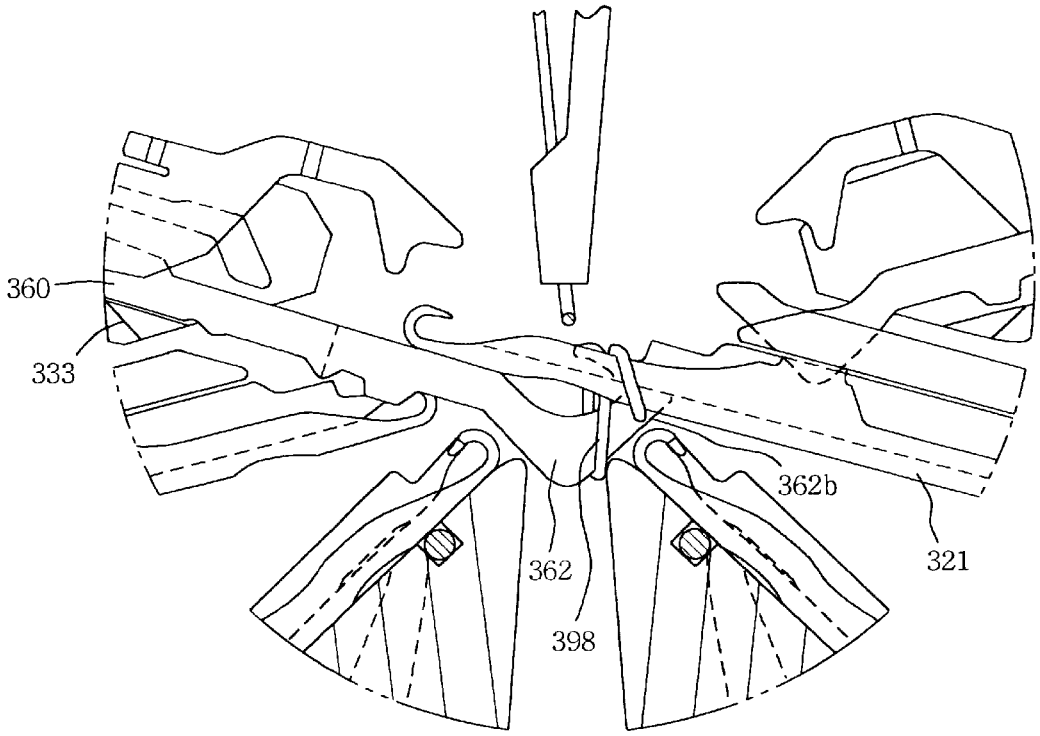

FIG. 12 is an enlarged view of the state around the trick gap during knitting in the modification of FIG. 11.

Figure 13:
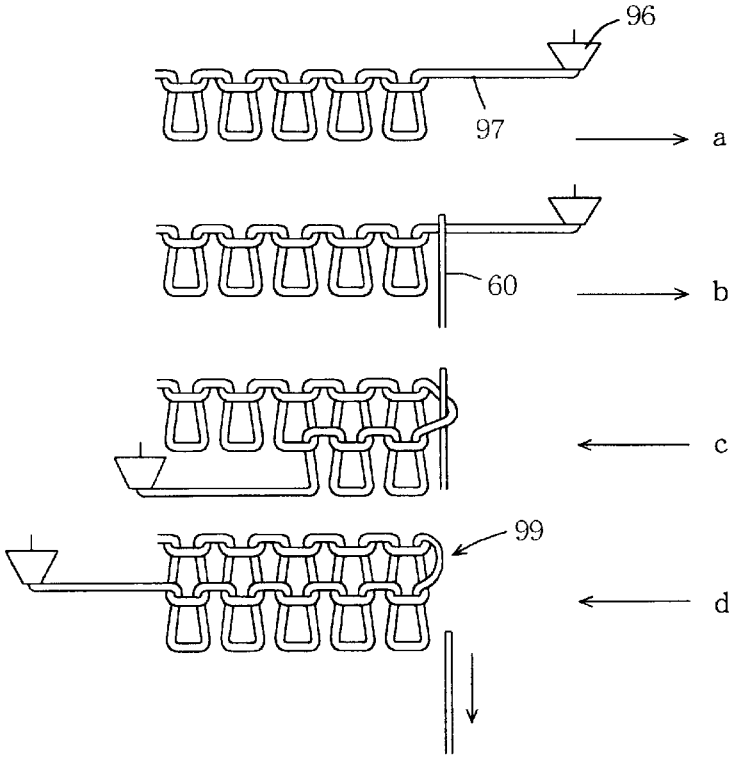

FIG. 13 shows a case in which a loop presser is used in the treatment of an edge of a fabric. It schematically shows knitting steps a through d of an edge portion of a fabric of plain stitch.

Figure 14:
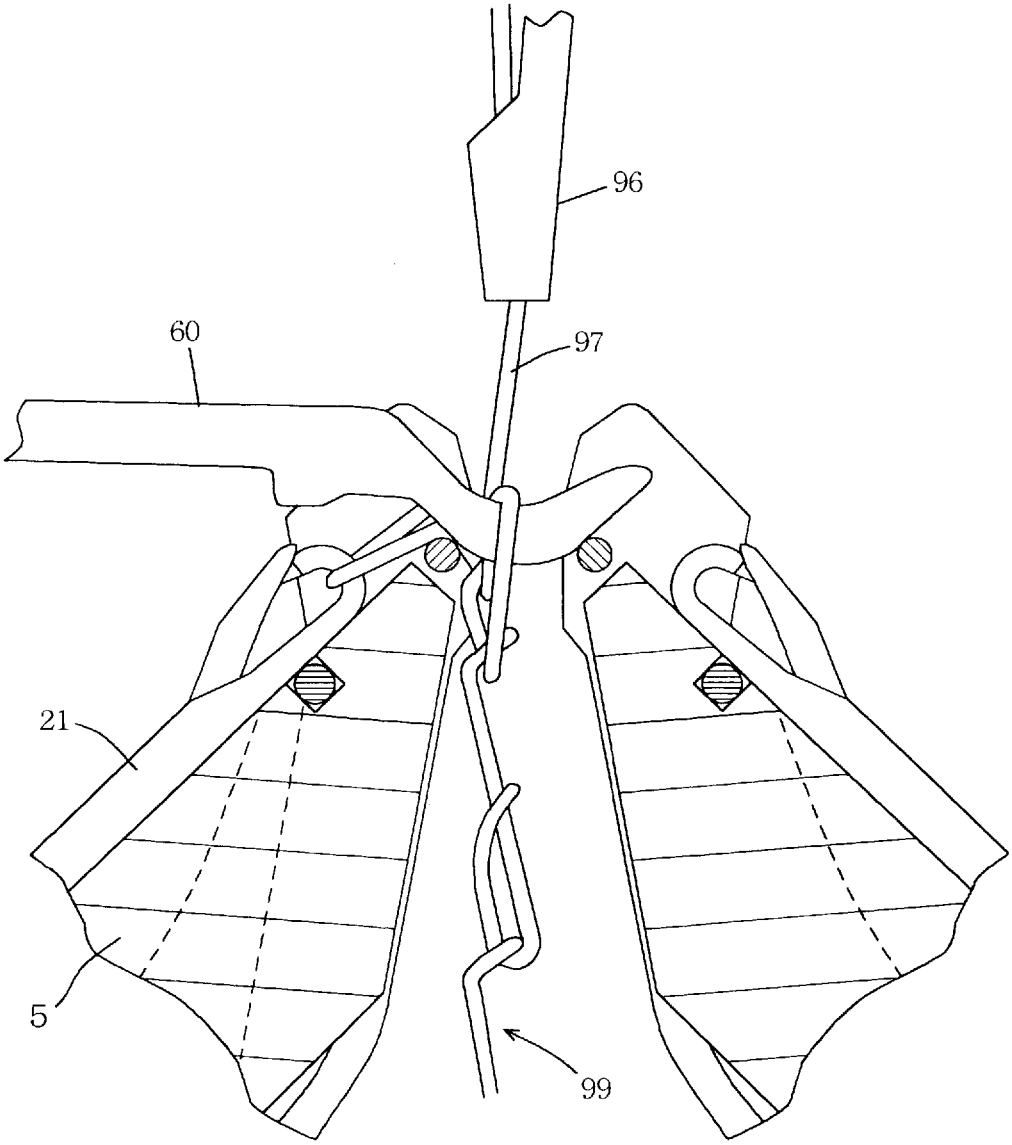

FIG. 14 is a partial sectional view of the state around the trick gap of the knitting machine of which loop presser 60 is in action.

Figure 15:
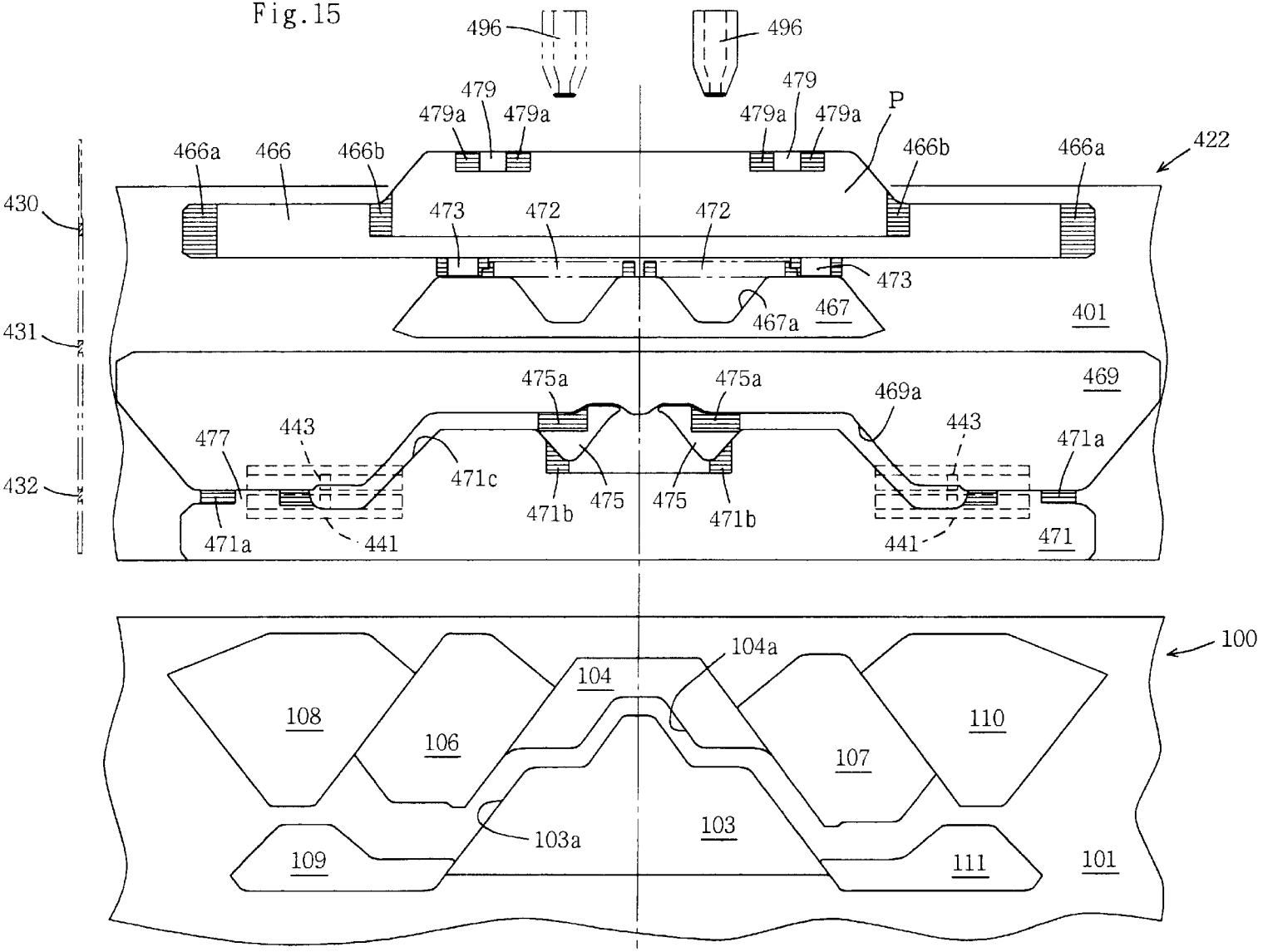

FIG. 15 is a perspective view of operating cams for needles and loop pressers.

Figure 16:
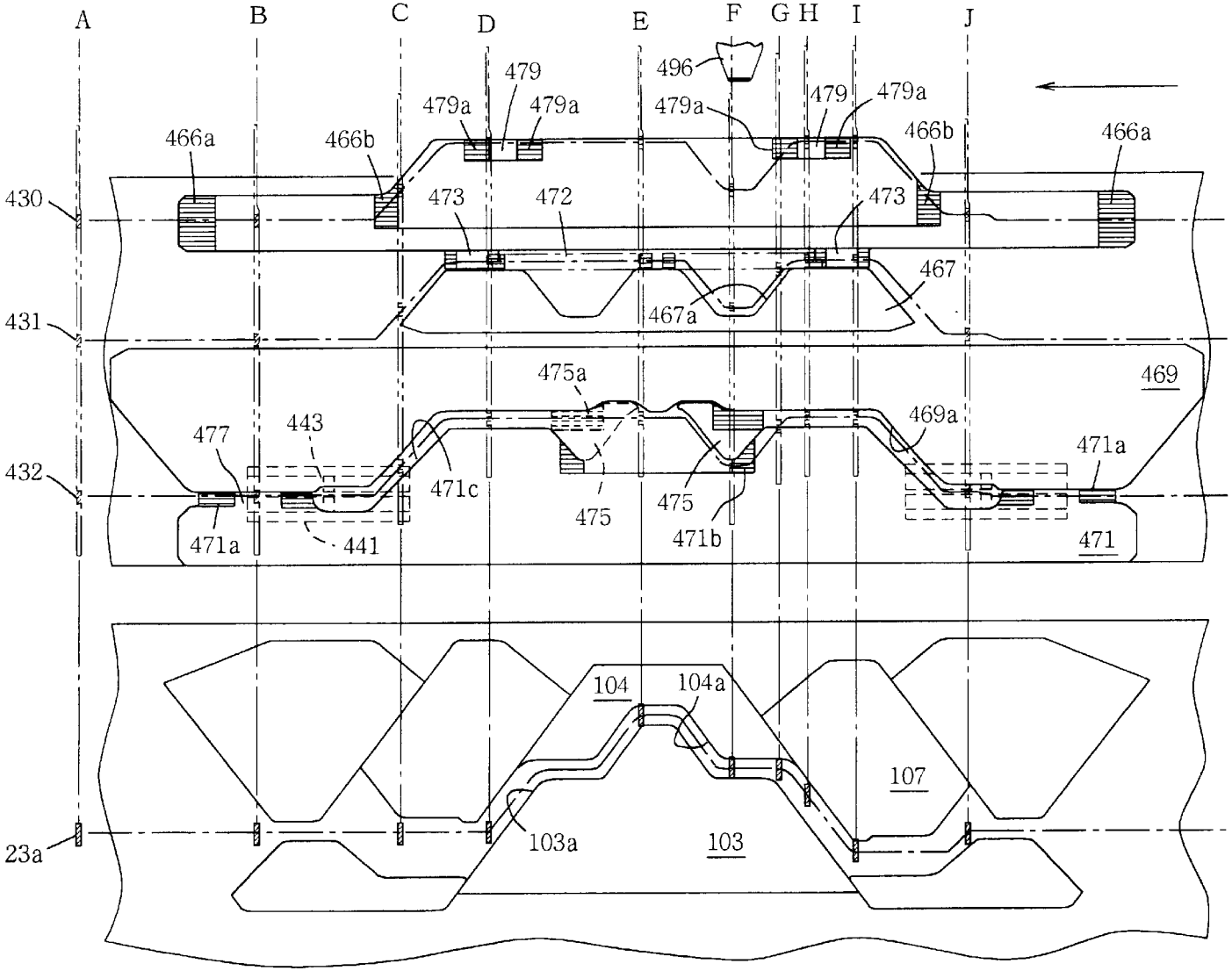

FIG. 16 is sectional view of the loop presser.

Figure 17:
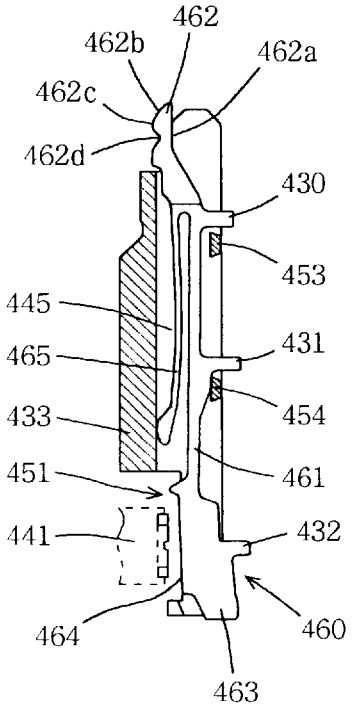

FIG. 17 is a diagram showing loci of the respective butts of the needle and the loop presser when the carriage travels to the left.

FIG. 18*a,b* and *c* is sectional views showing the states near the trick gap of the flat knitting machine at positions A through C of FIG. 17.

FIG. 18-*a* shows the state near the trick gap of the flat knitting machine at the position A of FIG. 17.

FIG. 18-*b* shows the state near the trick gap of the flat knitting machine at the position B of FIG. 17.

FIG. 18-*c* shows the state near the trick gap of the flat knitting machine at the position C of FIG. 17.

FIG. 19*a,b* and *c* is sectional views showing the states near the trick gap of the flat knitting machine at positions D through F of FIG. 17.

FIG. 19-*a* shows the state near the trick gap of the flat knitting machine at the position D of FIG. 17.

FIG. 19-*b* shows the state near the trick gap of the flat knitting machine at the position E of FIG. 17.

FIG. 19-*c* shows the state near the trick gap of the flat knitting machine at the position F of FIG. 17.

FIG. 20*a,b* and *c* is sectional views showing the states near the trick gap of the flat knitting machine at positions G through I of FIG. 17.

FIG. 20-*a* shows the state near the trick gap of the flat knitting machine at the position G of FIG. 17.

FIG. 20-*b* shows the state near the trick gap of the flat knitting machine at the position H of FIG. 17.

FIG. 20-*c* shows the state near the trick gap of the flat knitting machine at the position I of FIG. 17.

Figure 21:
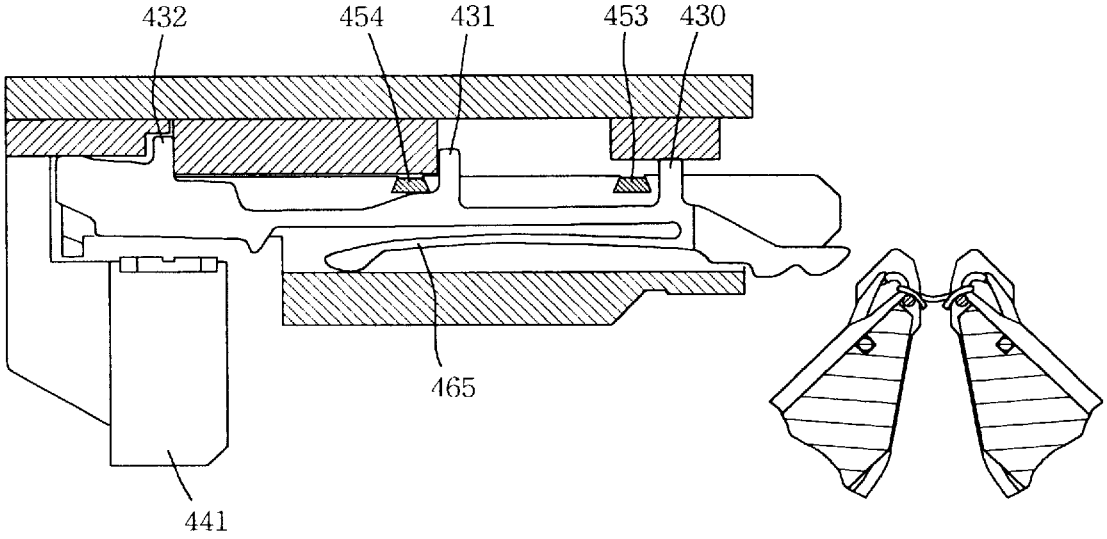

FIG. 21 shows the state near the trick gap of the flat knitting machine at the position J of FIG. 17.

EMBODIMENT

Embodiment 1

With reference to the attached drawings, one embodiment of the present invention will be described in the following.

FIG. 1 is a longitudinal sectional view of a flat knitting machine. In the flat knitting machine 1 of the present embodiment, the trick gap is formed by setting a front needle bed 3 and a back needle bed 5 in such a way that they oppose each other with a vertical hypothetical center line V (trick gap center line) as the center, and the heads of the needle beds form a chevron. The front needle bed 3 has the same construction as the back needle bed except the front needle bed 3 is not provided with loop pressing device 7 that will be described later.

In the following, therefore, only the back needle bed 5 will be described, and any part of the front needle bed 3 that is identical to a corresponding part of the back needle bed 5 is denoted by the same mark.

In the following description of various parts, with regard to the forward/backward movement directions of a needle of each needle bed, the trick gap side is the front, and the other side is the back, and the direction perpendicular to the surface of a needle bed is the up and down direction or the high and low direction.

A plural number of parallel grooves 9 are cut in the needle bed 5. A needle plate 11 is inserted in each of said grooves 9. A skewed notch 13 formed in the lower edge of each of these needle plates 11 a, b and a skewed notch 15 formed in the upper surface of the needle bed 5 are aligned with each other, and a wire 17 is passed through these notches, and although not illustrated, the back end of the needle bed is caulked to integrate the needle plates and the needle bed 5. As a result, a needle groove 19 is formed between two adjacent needle plates 11, 11. A needle 21, a jack 23 for controlling said needle 21, and although not illustrated, a selector, a selector jack, etc. are slidably inserted in the needle groove 19. A latch type needle 21 is inserted in the above-mentioned groove 19. The needle may be a compound one comprising a needle proper and a slider.

The needle bed 5 is provided with a metal bar 25 that is inserted in the needle plates in a direction perpendicular to the needles 21 to prevent the needles 21 from coming off the needle grooves 19. Grooves 26 are made in the lower surface of the top end of the needle bed at the same pitch as that of the grooves 9 for mounting needle plates. A sinker 27, that is doglegged when seen from the side, is inserted in each of the grooves 26. A part of a top-end square part 27*a* of the sinker 27 is attached to the needle bed 5. A hook part 27*b* at the lower end of the sinker 27 is fit into a notch in the lower surface of the needle bed. 29 denotes a wire that is passed through the sinkers 27. This wire 29 is for holding loops of a knitted fabric that hangs in the trick gap 6, and is related to the timing of knocking over during stitch formation. The sinker 27 may be a movable type rather than the above-mentioned fixed type. 2 denotes a carriage that reciprocates over the needle bed. 100 denotes a forward/backward movement cam that controls forward and backward movements of the needles, and will be described later. 120 denotes a cam for controlling forward and backward movements of loop pressers and yarn guides.

Figure 2:
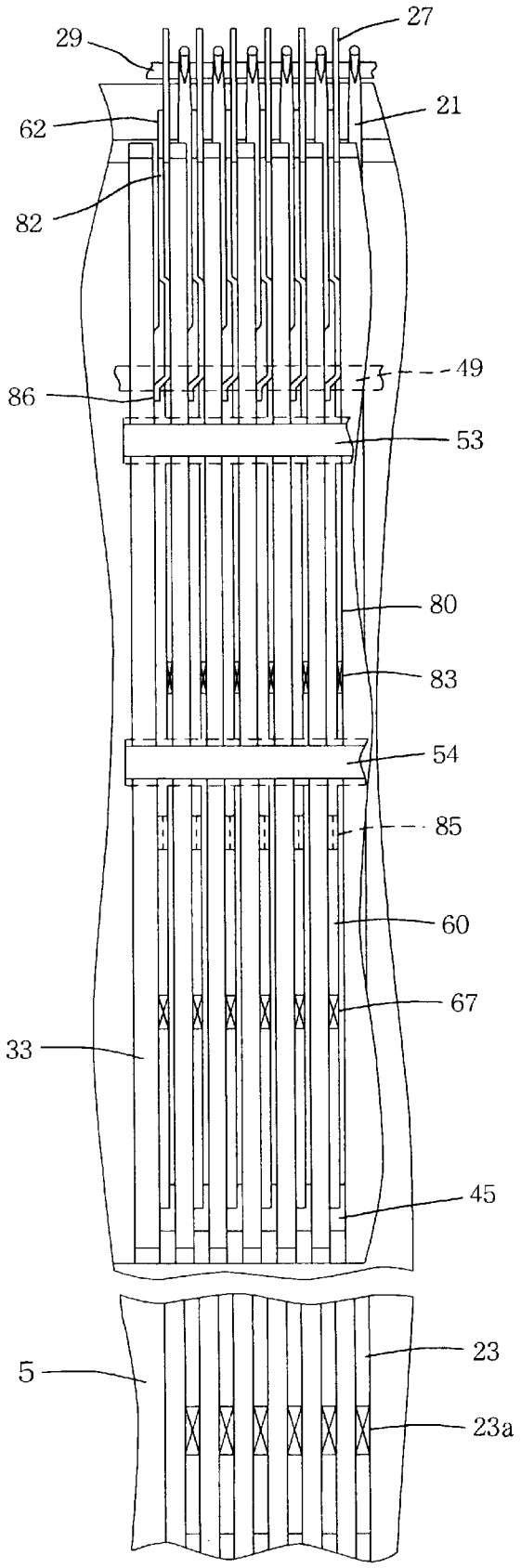
FIG. 2 is a partial plan view of a needle bed and an auxiliary bed.

FIG. 2 is a plan view showing an auxiliary bed 33 and the back needle bed 5. FIG. 3-*a* is a magnified view of a part of the auxiliary bed shown in FIG. 1. FIG. 3-*b* shows the loop presser 60 and the yarn guide 80 just as taken out of the auxiliary bed. FIG. 3-*c* is a sectional view along the line Y—Y of FIG. 3-*a*. The needle plate 11 consists of a rear part 11*a*, of which height is such that a jack butt 23*a* of the needle 21 inserted in the needle groove 19 between needle plates can protrude out of the needle plates, and an extended part 11*b* that is the head end part extended upward. The upper edge of the extended part 11*b* is used as the supporting surface for the auxiliary bed 33 on which loop pressers 60 are mounted. The auxiliary bed 33 will be explained below. The extended part 11*b* of the needle plate 11 is provided with a through hole 35. A bar 37 is put through the through holes 35, and screws 41 are put through a plate 39 and screwed into the bar 37 to fix the auxiliary bed 33 on the needle plates 11.

In the present embodiment, the auxiliary bed 33 is above the back needle bed 5 and is arranged to be approximately horizontal. Loop pressers 60 and yarn guides 80 are arranged on this auxiliary bed 33. In the auxiliary bed 33, a large number of grooves 45 are provided at the same pitch of the needle grooves 19 so that a loop presser 60 and a yarn guide 80 are positioned between each pair of adjacent needles 21, 21 of a large number needles mounted on the back needle bed 5. Each groove 45 is used as a common groove for mounting both a loop presser 60 and a yam guide 80. Thus a loop presser 60 and a yarn guide 80 are inserted together. A groove 47, that is perpendicular to said grooves 45, is made in the lower surface of the auxiliary bed 33 near the top end thereof. This groove 47 is deep enough to directly communicate with the grooves 45 for receiving loop pressers. Two wires, a small one 49 and a large one 50, are inserted in this groove 47, with the smaller wire 49 being placed above the other, and the wire 49 is made to protrude from the bottoms of the grooves 45 for receiving loop pressers.

The lower face of the rear portion, except the back end, of the auxiliary bed 33 is cut away to form an opening 51 that directly connects with the receiving grooves. 53 and 54 denote metal bars that prevent loop pressers 60 and yarn guides 80 from coming out of the receiving grooves.

In FIG. 3-*b*, the loop presser 60 is a roughly U-shaped plate. The loop presser 60 has a long shank (body proper) 61 of thin plate. A loop retainer 62 is formed on the top end of the shank 61, and a root end 63, serving as a part to be selected, is provided on the other end thereof. A surface to be attracted 64 is formed on the lower edge of this root end 63, and an elastic arm 65 is branched from the root end 63 to extend forward above the shank 61. 66 is a protrusion that is formed just ahead of said surface to be attracted 64. The loop retainer 62 consists of a flat lower edge 62*a*, a slope 62*b* extending from the top end of the lower edge forwards to the top end of the upper edge, and a circularly notched upper edge 62*c*. The loop retainer 62 is made thinner than the shank 61 by cutting one side thereof.

The elastic arm 65 is pressed to contact the metal bar 53. The loop presser 60 is made to move forward by the forward/backward movement cam that is mounted on the carriage 2 and will be described later. In a position where said protrusion 66 that is provided on the lower edge of the loop presser 60 contacts the bottom surface of the groove 45, the loop retainer 62 at the top end of the shank 61 is elastically energized downward with said protrusion 66 serving as the fulcrum for swing.

The root end 63 is provided with a control butt 67 that protrudes from the upper edge of the root end 63, and the control butt 67 is a part of the forward/backward movement control and engage with the forward/backward movement cam of the carriage 2 to move forward/backward the loop presser 60. Further, as shown in FIG. 4, when the control butt 67 is pressed by the guide cam 138 of the forward/backward movement cam, the surface to be attracted 64 is made to contact with the attracting surfaces 143, 144 of the selective actuators 141, 142 that are provided on the carriage and are exposed from the opening 51 of the auxiliary bed 33. The selective actuators will be described later. While the loop presser 60 is moved forward to or backward from the trick gap by the action of said forward/backward movement cam, the top end of the shank 61 is energized downward by the action of said elastic arm 65. As a result, a position control surface 68, that is formed from the middle of the shank 61 towards the lower edge of the top end thereof as shown in FIG. 3-*b*, is made to contact the wire 49, that is protruding from the groove bottom, to control the locus of the forward/backward movement of the loop retainer 62. 68*a* denotes a protrusion that controls the most retracted position of the loop presser 60, and 68*b* denotes a notch for moving the loop retainer 62 downward when the loop presser 60 is made to move forward. 62B, 62C and 62D in the diagram show the variations of the form of the loop retainer.

The yarn guide 80 is made of a plate member just like the loop presser 60 as shown in FIG. 3-*b* (the lower diagram). The yarn guide 80 consists of a long shank 81, a yarn retainer 82 at the top end, a control butt 83 at the center of the shank, an elastic arm 84 that is branched from the shank 81 between the yarn retainer 82 and the control butt 83, and a connector 85 that is a part of the shank 81 is bent toward the loop presser 60 to connect the yarn guide 80 and the loop presser 60. The root 87 of the yarn retainer 82 of the yarn guide 80 is bent so that when the yarn guide 80 is mounted in the groove 45 the yarn retainer 82 is arranged in the same plane with the loop retainer 62 of the loop presser 60. With this, both members are stored in a narrow space between the needle 21 and the sinker 27.

The yarn retainer 82 is constantly energized upward by the elastic arm 84, and the upper edge of the shank 81 is pressed to contact the metal bar 53. When the yarn guide 80 is mounted in the groove 45, the upper edge of said connector 85 contacts the lower edge of the elastic arm 65 of the loop presser 60. Because of this, even when the loop presser 60 is in the retracted position (initial position) where the protrusion 66 thereof does not contact the bottom of the groove 45, the loop presser 60 is prevented from being swung counterclockwise by the elastic energization of the elastic arm 65, and the control butt 67 is made to protrude from the upper surface of the auxiliary bed 33. The connector 85 is formed in a position that when the yarn guide 80 is in the initial position the connector 85 is just the stroke I away from the branch 69 of the loop presser 60.86 is a guide formed by bending, and is designed to prevent the yarn guide from falling down in the groove 45. The protrusion denoted by 88 serves as the fulcrum for swing when the yarn retainer 82 is swung downward.

FIG. 4-*a* is a perspective view of the forward/backward movement cam 100 for needles that is mounted on the carriage 2. FIG. 4-*b* is a perspective view of the forward/backward movement cam 120 for loop pressers 60 and yarn guides 80. Each of the forward/backward movement cams are bilaterally symmetrical along a center line.

With regard to the needle forward/backward movement cam 100, a raising cam 103 is arranged at the center of a cam plate 101. A bridge cam 104 is mounted ahead of the raising cam 103. Stitch cams 106, 107 are mounted on the left and on the right of the bridge cam 104, with a track for the jack butt 23*a* in between them. Marks 108 through 111 denote guide cams. With regard to needle selection, any desired needle is selected by a needle selecting means (not illustrated) that is arranged in the rear of the raising cam 103. The well-known system is used wherein the jack butt 23*a* is engaged with the raising cam 103 to control forward/backward movement of the needle 21.

The forward/backward movement cam 120 for yarn guides 80 and loop pressers 60 are provided with cam tracks 121, 122. The cam track that is closer to the trick gap is the cam track for the control butt 83 of yarn guide. 96*a*, b denote a yarn feeder. 96*a* that is indicated by a full line shows the position of the yarn feeder when the carriage is traveling to the left. 96*b* that is indicated by a dashed line shows the position of the yarn feeder when the carriage is traveling to the right.

The cam track 121 for the yarn guides 80 is formed by a guide cam 123 that has an approximately-M-shaped yarn guide lowering cam face on the back edge thereof, a guide cam 126 that is in the back of the guide cam 123 and has a swing cam 125 in the center, a center cam 128 arranged between the above-mentioned guide cam 123 and guide cam 126, trapezoidal raising cams 130, 131, and fixed presser cams 135, 136 rising from the cam plate 133. The above-mentioned raising cams 130, 131 are elastically energized all the time to protrude from the surface of the cam plate 133, and these cams 130, 131 hold their protruding state when there is no load on them. 130*a*, 13 1*a* denote slopes formed on the raising cams, and these slopes are directed to the surface of the cam plate 133. When the carriage 2 travels to the left, the slope of the preceding raising cam 130 is pressed by the control butt 83 of the yarn guide 80 to submerge into the cam plate 133, but the succeeding raising cam 131 catches the control butt 83 to move the yarn guide 80 forward. When the carriage 2 travels to the right, the above-mentioned operation is reversed, and the raising cam 131 is submerged, and the raising cam 130 acts on the control butt 83. The presser cams 135, 136 press the control butt 83 of the yarn guide that is in the advanced position to lower the yarn retainer 82 that is energized upward. The center cam 128 divides yarn guides to be advanced and yarn guides to be kept in the retracted position. Horizontally-hatched portions in the diagram indicate slopes directed to the surface of the cam plate 133.

The cam track 122 for the loop pressers 60 is formed by the guide cam 126, the swing cam 125, and the guide cam 138 arranged in the back. Cam faces 126*a*, 126*b* of the guide cam 126 serve as lowering cam faces to move the loop presser 60 backward from its advanced position. Cam faces 138*a*, 138*d* of the guide cam 138 move a selected loop presser forward when the carriage travels to the left, and the cam faces 138*b*, 138*c* serve as raising cams when the carriage travels to the right. The swing cam 125 is switched over according to the direction of travel of the carriage 2 and retract a loop presser 60 that has been advanced by the cam faces 138*a*, 138*b*. The cam slopes 138*e*, 138*f* of the guide cam 138 press the top surface of the control butt 67 of a loop presser that is in the initial position to make the surface to be attracted 64 contact the attractive surfaces 143, 144 of the selective actuators 141, 142.

The selective actuators 141, 142 are mounted on a bracket 98 (FIG. 1) provided in the back of the control cam 120, and stands face to face with said guide cam 138, with the auxiliary bed 33 being pinched between them. The selective actuators 141, 142 have flat attracting surfaces 143, 144, each in two rows, upper and lower, said attracting surfaces being magnetized by permanent magnet. Pole pieces of electromagnetic coils of release type electromagnets are provided at the center, in the direction of width, of the attracting surfaces to form the selectors 145, 146 for selecting any desired loop presser.

Next, the actual operation of the machine mentioned above in fabric knitting will be described. FIG. 5 shows the loci of the butts 23*a*, 67 and 83 of the needle jack 23, loop presser 60 and yarn guide 80 during stitch formation when the carriage 2 travels to the left. FIG. 6-*a* through FIG. 8-*c* are the diagrams showing the states of the respective positions A through I of FIG. 5 seen from the side of the flat knitting machine.

In the position A, it is before the arrival of the forward/backward movement cam of the carriage 2, and the butts 23*a*, 83 and 67 of the needle 21, yarn guide 80 and loop presser 60 are in their initial positions (resting positions) that are retracted ones from the trick gap. In this position, the surface to be attracted 64 of the loop presser 64 is located at the back opening 51 of the auxiliary bed 33, and the control butts 83, 67 of the yarn guide 80 and loop presser 60 are energized upward by the elastic arm 84 of the yam guide 80 to protrude from the surface of the auxiliary bed 33. (FIG. 6-*a*)

In the position B, the control butt 67 of the loop presser 60 is guided and pressed by the slope 138*e* of the guide cam 138, and the loop presser 60 is swung counterclockwise. As a result, the surface to be attracted 64 of the loop presser 60 is made to contact and be attracted by the attracting surface 143 of the selective actuator 141. From now on, while the surface to be attracted 64 is being kept to be attracted, the loop presser 60 reaches the selector 145 provided at the center of the selective actuator 141, and at this spot, it is selected whether the loop presser 60 must work or not. If the loop presser 60 is released by this selector 145 from the attraction of the surface to be attracted 64, the loop presser 60 will be swung clockwise by the action of said elastic arm 84 and return to the initial position (the state of A). As a result, the control butt 67 protrudes from the surface of the auxiliary bed 33, and the butt 67 will engage with the raising cam surface 138*a* of the succeeding guide cam 138 to be moved forward to the trick gap. On the other hand, if the loop presser 60 is not released by the selector 145 from the attraction of the surface to be attracted 64, the loop presser 60 will pass through the raising cam surface 138*a*, with the attraction being maintained by the attracting surface 143, to follow the locus indicated by the dashed line in FIG. 5. (FIG. 6-*b*)

In the position C, as the loop presser 60 is advanced along the raising cam surface 138*a*, the branch root part 69 of the loop presser 60 is in contact with the connector 85 of the yarn guide 80. After the contact with the connector 85 of the yarn guide 80, while the control butt 67 of the loop presser 60 is guided to the top of the raising cam surface 138*a*, the yarn guide 80 will be moved forward together with the loop presser 60 towards the trick gap. When the loop presser 60 is advanced and the protrusion 66 that is provided on the lower edge thereof contacts the bottom of the receiving groove, the top end of the loop presser 60 will be energized downward by the elastic arm 65, with this protrusion 66 serving as the fulcrum. As a result, while the travel towards the trick gap, the locus of the loop retainer 62 is determined by the position control surface 68 that is formed on the lower edge of the shank and the wire that engages with the surface 68. The loop retainer 62 advances almost horizontally to press, with the slope 62*b* at the top end thereof, the prolongations between adjacent stitch loops (not illustrated) and guide them to the lower edge 62*a* of the loop retainer. (FIG. 6-*c*)

In the position D, the control butt 67 of the loop presser 60 is guided to the top of the raising cam surface 138*a*, and the wire 49 is in the notch 68*b* of the position control surface 68. The top end of the loop retainer 62 protrudes to a point where it crosses over the sinker 27 of the opposing front needle bed 3 and completely cover the gap of the trick gap 6. The loop retainer 62 is moved downward to press the prolongations between stitch loops in the direction to lower the fabric. The diagram shows the state when the amount of swing of the loop presser 60 is the largest and the prolongations between stitch loops is pressed down to the greatest level, and this level of pressure is adjusted according to the magnitude of the tension in the stitch loops. In the position D, after the loop presser 60 pressed the stitch loops, while the jack butt 23*a* advances along the slop of the raising cam 103, the retainer 23 of the loop presser 60 holds the state of pressing and retaining the stitch loops and prevents the stitch loops from being pushed with the advancement of the needle 21, reliably clearing the stitch loops from the latch. In this position, the yarn guide 80 is guided to the front side of the center cam 128. (FIG. 7-*a* )

In the position E, the jack butt 23*a* has been guided to the top of the raising cam 103. (FIG. 7-*b*) Next, in the position F, after the jack butt 23*a* was guided to the top of the raising cam 103, the jack butt 23*a* is moved along the lowering cam surface of the bridge cam 104 to the position of the shoulder of the raising cam 103, and the control butt 67 of the loop presser 60 engages with the swing cam 125 to move the loop presser 60 backward. On the other hand, the control butt 83 of the yarn guide 80 engages with the raising cam 131 and the yarn guide 80 starts to move forward. During this advancement, the yarn guide 80 maintains the yarn retainer 80 in the state of being energized upward by the elastic arm 84. 96 denotes the yarn feeder. (FIG. 7-*c*)

In the position G, the yarn guide 80 is made by the raising cam 131 to advance to the cam top, and the control butt 83 is pressed by the presser cam 136 that is provided in the cam groove, and the yarn retainer 82 is moved downward against the upward energization by the elastic arm 84. With this, the yarn that is extended from the yarn feeder 96 to the needle 21 is pressed downward by the yarn retainer 82 and the yarn is guided to a position where the yarn can be caught by the hook of the needle 21. With the work of the stitch cam 107, the yarn is caught by the hook of the needle 21 that moves backward. (FIG. 8-*a* )

In the position H, the loop presser 60 is made to move forward again by the raising cam surface 138*d* to press down a new stitch loop that was just formed after the yarn was taken in by the stitch cam 107. At this time, the control butt 83 of the yarn guide 80 has been released from the pressure of the presser cam 136. And the control butt 83 is in engagement with the lowering cam surface 123*b* and the yarn guide 80 is moving backward.

In the position I, with the actions of the forward/backward movement cam of the carriage 2, the butts 23*a*, 67 and 83 of the needle 21, loop presser 60 and yam guide 80 have returned to their initial positions, respectively. (FIG. 8-*c*)

In the above-mentioned case, in the position H, the loop presser was introduced again to press down a stitch loop that was just formed. However, the control cam of the loop presser may be modified. For example, the swing cam 125 may be eliminated, and the concave that is provided in the center of the front edge of the guide cam 138 may be eliminated. By making the cam trapezoidal, the stitch loop of the preceding course may be retained while the stitch course is knitted.

With the provision of a selecting means for loop pressers, it is possible to allow only loop pressers, that correspond to needles of which stitch loops must be pressed down and retained according to knitting conditions, involve in knitting. In this way, it is possible to prevent useless pressing down and retaining of stitches that are held on needles at rest. That was inevitable in the prior art. As a result, loads of knitting on stitch loops can be reduced. Moreover, as the loop pressers can be selectively controlled, it is possible to avoid any troubles that are due to the action of loop pressers that are not involved in knitting. For example, it is possible to prevent collision of a loop presser directly beneath the carriage and the sinker of the opposing needle bed when a needle bed is racked. Moreover, although loop pressers are arranged for the respective needles, such an arrangement is not required for the yarn guides. For example, a yarn guide may be provided for every two or three needles. In that case, a spacer is inserted in a groove in which no yarn guide is inserted.

A Modification of Loop Pressers

A modification of loop pressers is shown in FIG. 9 and FIG. 10.

In FIG. 9 and FIG. 10, the auxiliary bed is mainly expressed, and other parts such as the support of the auxiliary bed and the forward/backward movement cam of the carriage are omitted. FIG. 9 shows the loop presser in its initial state, and FIG. 10 shows the loop presser in its advanced state where it is pressing down stitch loops (not illustrated). In contrast to the above-mentioned embodiment, in the present modification, no yarn guide is mounted in a receiving groove 245 that is formed on an auxiliary bed 233. Only a loop presser 260 is mounted in the groove 245.

The loop presser 260 is provided with an elastic arm 265 that is branched from a shank 261 at the rear of the loop retainer 262 and is extended backward below the shank 261. When the loop presser 260 is in its initial position, this elastic arm 265 energizes a forward/backward movement control butt 267 upward ,with a protrusion 269, that is formed on the lower edge of the loop presser, serving as the fulcrum. As a result, the upper edge of the shank is made to contact a metal bar 253. While the loop presser is moved forward or backward, the upper edge of the shank and the metal bar 253 are in contact with each other. When the loop presser is in the advanced position, a position control surface 268, that is formed to protrude from the upper edge of the shank, faces the metal bar 253. As a result, said position control surface 268 serves as the fulcrum of swing and the loop retainer 262 is swung downward against the upward energization by the elastic arm 265. In this example, a protrusion 264*a*, that is formed on the upper edge of a root end 263 of the loop presser 260, is pressed by a cam that is not illustrated to make a surface to be attracted 264 contact the attracting surface of a selective actuator 141.

When the loop pressers are structured just as in the above-mentioned embodiments, it is sufficient to provide one auxiliary bed for receiving loop pressers to only one of the front and back needle beds. Hence an open space can be secured on the other needle bed. In particular, in the first embodiment, both loop pressers and yarn guides are arranged in parallel with each other on the same auxiliary bed. Hence a greater open space can be secured. When another auxiliary bed, on which other knitting members are assembled, is installed in this open space, one can design a flat knitting machine having multiple functions, that is very compact in comparison with the conventional machines in which loop pressers are provided on both the front and back needle beds. For example, when an auxiliary bed in which transfer jacks are mounted as knitting members,just as one described in Japanese Provisional Patent Hei 4-337328, internal narrowing of rib fabric can be done efficiently by using the needles of the needle beds and the transfer jacks.

Application to a Flat Knitting Machine with Four Needle Beds

Next, an example of application of loop pressers to a flat knitting machine with four needle beds will be described. The flat knitting machine is provided with two pairs of needle beds; one needle bed in the front and the other in the rear with a trick gap in between, and one pair in the upper stage and the other pair in the lower stage.

In the flat knitting machine with four needle beds, knitting of a fabric can be done by using needles of the front and back needle beds of the lower stage. Moreover, the needles of the front lower needle bed and the back upper needle bed can be assigned to knitting of a front body, and the needles of the back lower needle bed and the front upper needle bed can be assigned to knitting of a back body. In this way, a tubular body and tubular sleeves are knitted on the flat knitting machine. Thus knit clothes such as pullovers and vests can be produced without sewing steps. For details of such knitting methods with a flat knitting machine with four needle beds, reference should be made to Japanese Provisional Patent Hei 2-229248 and Japanese Provisional Patent Hei 4-236852 of the present applicant, and explanation is omitted herein.

As partially shown in FIG. 11, needle plates, that are to be mounted on the lower front and back needle beds FD, BD, are extended upward, and the upper needle beds BU, etc. are supported and fixed on said extended parts, and compound needles 321, each comprising a slider and a needle proper, are mounted in parallel with each other in the front and back needle beds of both the upper and lower stages. In the present embodiment, loop pressers 360 are provided above the front and back needle beds BU, etc., and the auxiliary beds 333 for mounting loop pressers 360 are supported by extending upward the needle plates 311 of the upper needle beds BU, etc., just like the case of the support for the upper needle beds. Like the first embodiment, a loop presser 360 and a yarn guide 380 are set in the same groove on the auxiliary beds 333.

If the loop pressers of FIG. 1 described above are applied to a flat knitting machine with four needle beds 301, the angle between the loop pressers 60 and the needles 321 of one upper needle bed FU or BU will be large. Moreover, as the lower edge 62*a* of the loop retainer 62 is made flat, when a needle 321 of the upper needle bed FU or BU is moved forward, a stitch loop 398 being held on the needle 321 may be pressed to slip off the slope 62*b* and come to the lower edge 62*a*. In short, the loop 398 can not be retained reliably.

Accordingly, in the loop presser 360 of the present embodiment, the lower edge of the loop retainer is formed into an approximate V shape seen from the side, and the crossing point of the lower front edge 362*b* and the back edge 362*a* of the loop retainer 362, is positioned in such a way that it comes deep into the trick gap when the retainer is in action. (62B of FIG. 3-*b*)

FIG. 12 shows an enlarged view of the state around the trick gap during knitting. When the needle 321 of an upper needle bed is to be moved forward, the loop presser 360 of an auxiliary bed 333, that is opposing to the upper needle bed with a trick gap in between, is actuated to press and retain the stitch loop 398 by the front edge 362*b*, that extends deep into the trick gap, of the loop retainer 362. In this way, the stitch loop 398 is prevented from coming up together with the needle 321.

Application to Knitting of an Edge Portion

Next, an example will be described, where the loop pressers are used in another application. During knitting of a fabric, the carriage is made to travel to the right to feed the yarn to the desired needles to form a stitch course. Then the carriage is reversed to travel to the left and knit a stitch course that follows the above-mentioned course. This operation is repeated to knit a fabric of a desired loop length. However, at both edges of the fabric, where the direction of knitting is reversed, the tension in the yarn is not equal to that in other portions. This is a problem because the sizes of stitches in these edge portions are irregular. The cause of this is as follows. The stitch loop of a side edge wale, that is located in the ending side of the course knitting, extends to an adjacent stitch loop on the fabric side. The other side of this edge stitch loop, however, extends to the yarn feeder, and after reversal of the carriage, when a stitch loop of the subsequent stitch course is formed, the yarn is drawn out not only from the yarn feeder but also partly from the stitch loop of the side edge wale that was knitted last in the previous course. As a result, the stitch loop, that was knitted last in the previous course, is reduced in size, and the stitches on the side edges of the fabric become irregular.

This problem is not limited to plain stitch and rib stitch. It also occurs in knitting of a tubular fabric wherein fabrics knitted on the respective needle beds are connected at both edges of the knitting widths. In the case of circular knitting, the yarn of the stitch loop at the edge of the knit-ending side of one fabric is drawn out when the stitch loop at the edge of the knit-starting side of another fabric is formed. As a result, a vertical line is formed in the side edge portion where the direction of yarn feeding is reversed.

In the present embodiment, with an objective of moderating the above-mentioned problem, loop pressers are introduced in knitting a fabric.

FIG. 13 shows the outline of knitting steps of a side edge portion of a plain stitch fabric. FIG. 14 is a partial sectional view showing the state around the trick gap of a flat knitting machine of which loop presser is in action. In step a, a yarn feeder 96 is made to travel from the left to the right to feed the yarn to needles 21 of the back needle bed to knit a stitch course of a plain stitch fabric 99. In step b, before stitch loops of the next course are formed, a loop presser 60, that is located in the side edge of the knit fabric, is made to move forward to press down and retain the yarn 97, that extends from the stitch loop that was formed last to the yarn feeder 96, with a loop retainer 62 of the loop presser 60. While the advanced state of the loop presser 60 is maintained, in step c, the yarn feeder is reversed to travel and form the next stitch course. In step d, the loop presser 60 is made to move backward.

It is not necessary to hold the advanced state of the loop presser while knitting all stitch loops of the next course. The loop presser can be moved backward at any time after formation of the stitch loop of the right edge wale. When stitch loop sizes of two or three wales including the side edge wale of the knitting width are not stable, loop pressers corresponding to these wales may be used in knitting. To moderate interference with the yarn when the loop retainer is moved backward, it is desirable to give the loop retainer a configuration such as one shown in 62C of FIG. 3-*b*.

When knitting is effected by using loop pressers 60 as described above, at the side edge of the fabric, the yarn is made to wind around the loop presser 60, and the yarn is pressed by the loop retainer 62. As a result, the yarn 97 is prevented from being pulled out of the previous course's stitch loop that was formed last.

When the above-mentioned operation of the loop presser 60 is to be controlled by the above-mentioned control cam that is provided on the carriage, the procedure is as follows: When the carriage travels to the left to knit the next stitch course, a loop presser 60, that is located at the side edge of the fabric, is selected by the selective actuator 141, and the loop presser 60 is made to move forward to the trick gap by the raising cam face 138*a*. While the stitch loop of the side edge wale is formed by the stitch cam 107, the loop presser 60 is made to maintain its advanced position. After that, the loop presser 60 is made to move backward by the succeeding lowering cam surface 126*b*. In this case, to prevent the swing cam 125, that is provided in the center, from working as the lowering cam of the loop presser, the swing cam 125 must be, for example, a cam that can be controlled to protrude or dip, and it must be set in the dipped position.

In place of the above-mentioned arrangement, the raising cam surface 138*d* may be arranged closer to the swing cam 125 to advance the timing of advance of the loop presser. With this, the modification of the control cam can be minimal.

Application to Intarsia Knitting

As an example of another use (not illustrated), will be described the use of loop pressers for increasing the pattern width at the intarsia pattern boundary in intarsia knitting. In this case, when a stitch course, that is immediately preceding a stitch course of which pattern width is to be increased, is knitted, the yarn feeder is shifted to the outer side of a needle that is at the start point of the knitting of the next course of which knitting width is to be increased. Before knitting the next stitch course, a loop presser that is on the outside of the knitting width of the next course is made to move forward to press and retain the yarn, that extends from the stitch loop that was knitted last in the last course to the yarn feeder, with the loop retainer thereof. Next, the yarn feeder is reversed to travel, and at the side edge of the above-mentioned knitting width, the yarn is wound over the loop retainer; under this condition, the loop presser is kept in the advanced position till at least the stitch loop of the side edge wale of the next course is formed. After that, the loop presser may be moved backward to undone the engagement between the loop retainer and the yarn. In this way, the pattern width of intarsia pattern can be extended without any limitation. This is also applicable, without any change, to widening knitting in fashioning.

The Most Preferred Embodiment

The most preferred embodiment will be described in the following. The loop presser of the present embodiment is structured as a loop presser of a type that the loop presser itself also has the above-mentioned function of the yarn guide. FIG. 15 is a perspective view showing the respective control cams for needles and loop pressers. FIG. 16 (17) is a sectional view of the auxiliary bed. The auxiliary bed 433 is provided with a large number of receiving grooves 445, and these grooves 445 are arranged at the same pitch as the needle grooves. Loop pressers 460 are inserted in these individual receiving grooves 445.

The back lower surface of the auxiliary bed 433 is cut away, except the back end, to form an opening 451 that is directly connected to the receiving grooves 445. 452, 454 denote metal bars that prevent the loop pressers 460 from coming out of the receiving grooves 445.

Loop pressers

The loop presser 460 is made of a thin plate member; it has a loop retainer 462 at the top end of its body proper 461 being a thin plate shank. In the loop retainer 462, as shown in FIG. 16 (17), the upper edge 462*a* is formed flat, and the front edge 462*b* is formed circular, and a notch 462*d* is formed in the lower edge 462*c*. The loop retainer 462 is made thinner than the body proper 461 by cutting one side thereof. The root end 463 at the back end of the body proper 461 is provided with a surface to be attracted 464, that is attracted by an attracting surface of a selective actuator 441. Below the body proper 461, an elastic arm 465 is provided, said elastic arm 465 is branched from the body proper and extends backward. On the upper surface of the body proper 461, are protrusively provided, from the top, a first butt 430, a second butt 431 and a third butt 432. The top end of the elastic arm 465 contacts the bottom of the receiving groove to support the loop presser 460. In the present embodiment, the arm 465 is made to be elastic and is subjected to compressive deformation. Reversely, the body proper 461 being the shank may be made to be elastic and be subjected to compressive deformation.

When the loop presser 460 is in its retracted position (initial position, FIG. 16 (17)) in the receiving groove 445, the upper surface of the body proper in the rear of the second butt 431 is pressed to contact the metal piece 454 that is mounted on the auxiliary bed, and the loop presser 460 is kept in that position with its elastic arm 465 being compressed to deform. The loop presser 460 is energized upward by the repulsive force that is generated by the compressive deformation of this elastic arm 465.

The forward and backward movements and swing of the loop pressers 460 are controlled by the control cam that is mounted on the carriage and will be described later.

Carriage

The control cam for needles and the control cam for loop pressers that are mounted on the carriage are arranged bisymmetrical about the center line X. The control cam for needles 100 is identical to that of the above-mentioned embodiment. A raising cam 103 is arranged in the center of a cam plate 101, and a bridge cam 104 is mounted ahead of the raising cam 103. Stitch cams 106, 107 are mounted on the left and on the right of the bridge cam 104, with a track for the jack butt 23*a* in between them. 108 through 111 denote guide cams. 496 denotes a yarn feeder, and the full line indicates the position of the yarn feeder when the carriage is traveling to the left, and the dashed line indicates the position of the yarn feeder when it is traveling to the right.

Loop presser control cam

The loop presser control cam 422 makes the loop presser move forward and backward, and in cooperation with the arm 465, makes the loop retainer 462 swing. The cam plate 401 of the loop presser control cam 422 is provided with, from the trick gap, a first guide cam 466, a second guide cam 467, a third guide cam 469, and a fourth guide cam 471. A passage route for the second butt 431 of a loop presser, that is selected by a selective actuator 441, is formed between the first guide cam 466 and the second guide cam 467. On this route, are provided a pair of fixed pressers for the second butt 473, 437, that are arranged bisymmetrically and press the second butt 431, and movable pressers for the second butt 472, 472, that are arranged between these fixed pressers 473, 473 and can be controlled to protrude/sing. The height of the pressing surface of this fixed presser for the second butt 473 is set a little lower than the height of the surface of the first guide cam 466, and the fixed presser 473 is formed integral with the first guide cam 466. Between the second guide cam 467 and the third guide cam 469, is provided a passage route for the second butt 431 of a loop presser that is not selected.

Between the third guide cam 469 and the fourth guide cam 471, is formed a passage route for the third butt 432 of the loop presser 460, and are provided a pair of lowering cams 475, 475, one on the right and one on the left, that engage with the front edge of the third butt 432 to move the loop presser 460 backward. The lowering cam 475 is energized in such a way that it protrudes from the surface of the cam plate 401 when there is no load on it. 475a denotes a slop that is formed on the raising cam 475 and is directed to the height of the surface of the cam plate. When the carriage travels to the left, the slope of the preceding lowering cam 475 is pressed by the third butt 432 of the loop presser 460 to sink into the cam plate. The succeeding lowering cam 475 engages with the third butt 432 to move the loop presser 460 backward. When the carriage travels to the right, the operation is reverse to the above-mentioned one. Thus the lowering cam 475 is arranged to operate for only one direction of travel of the carriage.

477 is a presser for the third butt, that presses the third butt 432 of the loop presser 460 to make a surface to be attracted 464 contact the attracting surface of the selective actuator 441, and is formed as a part of the fourth guide cam 471. On a part of the fourth guide cam 471 that contacts the lowering cam 475, is formed a slope 471*b* that extends from the height of the surface of the cam plate 401 to the height of the surface of the guide cam 471. The function of this slope 471 will be described later.

The thicknesses (amounts of protrusion from the surface of the cam plate) of the second guide cam 467 and the third guide cam 469 are greater than those of the first cam guide 466 and the fourth cam guide 471, and are formed in such thicknesses that there are small clearances between the second and third guide cams and the surface of the auxiliary bed. The thickness of a part P of the first guide cam 466, that is in the center of the cam 466 and close to the trick gap, is formed one step thinner. There are a pair of pressers 479, 479, one on the left and one on the right, that rise from this thinner part. The presser 479 presses the first butt 430 of the loop presser 460, that is in the advanced position, to move the loop retainer 462 downward. The fixed presser for the second butt 473 is formed to have a thickness that is greater than that of the presser for the first butt 479. 441 denotes the selective actuator and it has a structure that is similar to that of the above-mentioned invention. 479*a*, 466*a*, 466*b* and 471*a* in the diagram denote slopes.

Operation

Next, the actual operation of the above-mentioned machine in knitting of a fabric will be described. FIG. 16 shows the loci of the butts 23*a*, 430, 431 and 432 of the jack of the needle 21 and the loop presser 460, respectively, when the carriage travels to the left to form stitches. FIG. 18-*a* through FIG. 21 are diagrams showing the states in the positions A through J of FIG. 16, that are seen from the side of the flat knitting machine. At this time, the preceding one of the fixed/movable pressers for the second butt is in action, and the succeeding one is depressed and is not in action.

In the position A, it is before the arrival of the control cams that are mounted on the carriage, and the butts of the needle 21 and the loop presser 460 are in their initial positions (resting positions) that are retracted ones from the trick gap. In this position, the surface to be attracted 464 that is on the root end 463 of the loop presser is located at the back opening 451 of the auxiliary bed. And the upper surface of the body proper at the rear of the second butt 431 is pressed to contact the metal bar 454 that is mounted on the auxiliary bed, and the elastic arm 465 is pressed downward to undergo compressive deformation. The rear end of the loop presser 460 is energized upward to protrude by the repulsive force of the elastic arm 465. (FIG. 18-*a*)

In the position B, the third butt 432 of the loop presser 460 is pressed by the presser for the third butt 477 that is integrally formed on the fourth guide cam 471. At this time, the first butt 430 is in contact with the surface of the first guide cam 466, and the loop presser 460 is swung counterclockwise, with the contact point between the first butt 430 and the first guide cam serving as the swing fulcrum. As a result, the surface to be attracted 464 is made to contact the attracting surface of the selective actuator 441 and be attracted by it. (FIG. 18-*b*)

From the position B and beyond, while the surface to be attracted 464 is being kept to be attracted by the attracting surface of the selective actuator 441, the surface to be attracted 464 reaches magnetic pole 443 at the center thereof When the loop presser 460 is released from the attraction at this spot, the root end 463 thereof will be swung upward by the repulsive force of the elastic arm 465. As a result, the third butt 432 protrudes from the surface of the auxiliary bed to engage with the raising cam surface 471*c* of the fourth guide cam 471, and the loop presser 460 advances towards the trick gap (Position C). During this advancement, the contact between the metal bar 454 and the upper edge of the loop presser is lost, and the first butt 430 is guided to the part P of the first guide cam 466. As the first butt 430 is released from the pressure from the cam surface, the body proper 461 of the loop presser 460 is pushed upward by the repulsive force of the elastic arm 465. However, the upper surface of the root end 463 of the loop presser 460 contacts the surface of the fourth guide cam 471 in the receiving groove 445, and the upper surface of the body proper between the first butt 430 and the second butt 431 is pressed to contact the metal bar 453, and the loop presser 460 holds this position. (FIG. 18-*c*)

In the position D, the third butt 432 of the loop presser 460 is guided to the top of the raising cam surface 471*c* of the fourth guide cam 471, and the top end of the loop retainer 462 crosses, when seen from the side, with the opposing sinker 481 of the front needle bed to completely block the clearance of the trick gap 483. At this time, the second butt 431 is at the position of the fixed presser for the second butt 473 that is provided in the rear of the first guide cam 466, and as shown in the diagram, is subjected to its pressure. As a result, the loop retainer 462 is moved downward to press the prolongation between stitch loops 485 in the direction of lowering the fabric. (FIG. 19-*a*)

From the position D to the position E, the second butt 431 is pressed by the movable presser for the second butt 472 that is provided adjacent to the presser 437, and the loop retainer 462 is kept in the lowered position to prevent the stitch loop 485 from rising when the jack butt 23*a* engages the raising cam surface 103*a* of the raising cam 103 and the needle 21 is moved forward. (FIG. 19-*b*)

FIGS. 19-*a* and 19-*b* show that the loop retainer 462 is swung downward to the greatest level to heavily press the prolongation between stitch loops 485. And this amount of swing is automatically adjusted according to the level of the tension in the stitch loops themselves. When the tension in the stitch loops is greater than the repulsive force of the elastic arm, the loop presser 460 will be swung counterclockwise against the repulsive force of the elastic arm. Hence the loop presser 460 will not press down the stitch loops excessively. So there will be no breakage of the yarn. (FIG. 19-*c*)

The yarn feeder 469 is in the position F. The jack butt 23*a* is moved along the lowering cam surface 104*a* of the bridge cam 104 to go back to the shoulder position of the raising cam 103. In this position, the third butt 432 of the loop presser 460 engage with the lowering cam 475 to move the loop retainer 462 backward from the trick gap 483 to avoid interference with the yarn feeder 496 and prevent the yarn 497, that is discharged from the yarn feeder 496, from riding on the loop retainer.

After the passage of the yarn feeder 496, from the position F through the position H, the second butt 431 of the loop presser 460 is made to engage with the raising cam surface 467*a* of the second cam guide 467 to move again the loop retainer 462 forward to a position where it blocks the clearance of the trick gap 83.

The fourth guide cam 471, that contacts the third butt 432 of the loop presser 460 from the position F to the position G, is provided with a slope 471*b* that extends from the height of the surface of the cam plate 401 to the height of the surface of the guide cam. When the second butt 431 is made to move forward by the raising cam surface 467*a* of the second guide cam 467, the third butt 432 will be pressed by the slope 471*b* and the subsequent cam surface, and the loop presser 460 will be moved forward with the loop retainer at the top end thereof being raised. With this, the yarn 497, that is discharged from the yarn feeder 496, is retained by the front edge 462*b* and the following lower edge 462*c* of the loop retainer 460 to guide the yarn 497 into the notch 462*d* this formed in the lower edge 462*c* of the retainer. (FIG. 20-*a* )

In the position H, the first butt 430 is pressed by the presser for the first butt 479 that is provided on the first guide cam 466, and the loop retainer 462 is lowered against the upward energization by the elastic arm 465. In this way, the yarn 497, that is discharged from the yarn feeder 496, is pressed down by the loop retainer 462 to guide the yarn 497 to a position in which the yarn 497 can be caught by the hook of the needle 21. In the position G, as the loop retainer 462 moves down from its upper position of the swing to press and retain the yarn 497, even when the yarn is drawn out without forming a stitch loop in Jacquard, etc. and catchment of the yam 497 is more difficult, the loop retainer 462 can securely guide the yarn 497. (FIG. 20-*b*)

In the position I, the second butt 431 of the loop presser 460, that is holding the above-mentioned position, is pressed further by the fixed presser for the second butt 473 to press down and retain a new stitch loop 489 that was just formed by the stitch cam 107. (FIG. 20-*c*)

After that, the third butt 432 of the loop presser 460, that is in the advanced position, is engaged with the lowering face 469*a* of the third guide cam and the loop presser 460 is moved back.

In the position J, due to the actions of the control cams of the carriage, the butts 23*a*, 430, 431 and 432 of the loop 21 and the loop presser 460 are moved back to their initial positions, and the state of the needle bed is identical to that of FIG. 18-*a*. (FIG. 21)

When structured as described above, the loop pressers can perform both the function of loop presser and the function of yarn guide. Hence the configuration of the machine can be made simpler than the case of Embodiment 1.

In the above-mentioned embodiment, loop pressers are arranged at the same pitch as the needles. However, loop pressers may be arranged at one half pitch of the needles (double density).

Embodiments of the present invention were described above. The present invention is not limited by the above-mentioned embodiments and can be embodied within a scope that does not deviate from the gist of the present invention.

We claim:

1. A flat knitting machine provided with loop pressers comprising:

at least a pair of needle beds, one in a front and an other in a back, facing against each other with a trick gap in between and having a large number of needles arranged to be moved freely forward and backward and having a large number of sinkers arranged between needles;

an auxiliary bed supporting a large number of loop pressers so that the pressers can be moved freely forward to and backward from said trick gap and provided above at least one of said needle beds;

wherein said needles and loop pressers are moved forward to and backward from said trick gap by cam engagement with forward/backward movement cams provided on a carriage reciprocating over said needle bed, said flat knitting machine being characterized in that said loop presser has a shank, a loop retainer provided at a top end of the shank, forward/backward movement controls provided on a upper edge of the shank, and an arm branching and extending from the shank, and a length of said loop retainer is made longer than a width of the trick gap, said auxiliary bed is provided with a groove for holding the loop presser, and the arm or the shank of the loop presser is compressed and deformed for swingably containing the loop presser in the groove, the loop retainer of the loop presser is made by said forward/backward movement cam to advance over an opposing needle bed, and a swing locus control means is provided for swinging said loop retainer when said loop presser is moved forward/backward.

2. A flat knitting machine of claim 1 being characterized in that said carriage is provided with a selection means for selecting a loop presser for being cam-engaged with said forward/backward movement cam.

3. A flat knitting machine of claim 1 being characterized in that said swing locus control means is arranged so that during the forward movement of the loop presser, the loop retainer is swung downward by repulsive force according to said compressive deformation, and during the backward movement of the loop presser, the loop retainer is swung back to a original position against said repulsive force.

4. A flat knitting machine of claim 1 being characterized in that the loop retainer is energized upward by the repulsive force according to compressive deformation of said loop presser, and the loop retainer is made to swing downward, in the advanced position of the loop presser, by said swing locus control means against said upward energization.

5. A flat knitting machine of claim 2 being characterized in that said selection means comprises a selection part at a rear part of the loop presser and is swingably energized upward, a pressing cam provided in a position on the carriage corresponding to said selection part, and an actuator provided with an attractive part being able to attract and release, an upper edge of the selection part is pressed by said pressing cam for making the selection part swing downward for making a lower edge of said selection part contact the attractive part of said actuator and be attracted and held, and the selection part of the loop presser selected is released from the attraction by said attractive part for swinging said shank upward and making said forward/backward movement control part cam-engage with the forward/backward movement cam of said carriage.

6. A flat knitting machine of claim 1 being characterized in that said loop presser is also a yarn guide.

7. A knitting method using a flat knitting machine comprising:

at least a pair of needle beds, one in a front and an other in a back, facing against each other with a trick gap in between, and a large number of needles, arranged to be moved freely forward and backward in said needle beds and a large number of sinkers arranged between needles in said needle beds, and a yarn feeder above the trick gap for feeding yarn to said needles;

an auxiliary bed supporting a large number of loop pressers so that the pressers can be moved freely forward to and backward from said trick gap positioned above at least one of said needle beds;

a carriage reciprocating over said needle beds, and provided with a selecting means for selecting a loop presser being to be cam-engaged said forward/backward movement cams;

wherein said needles and loop pressers are moved forward to and backward from said trick gap by said cam engagement with said forward/backward movement cams provided on the carriage, wherein said loop presser has a shank, a loop retainer provided at a top end of the shank, forward/backward movement controls provided on a upper edge of the shank, and an arm branching and extending from the shank, and a length of said loop retainer is made longer than a width of the trick gap, wherein said auxiliary bed is provided with a groove for holding a loop presser, and the arm or the shank of the loop presser is compressed and deformed for swingably containing the loop presser in the groove, wherein the loop retainer of the loop presser is made by said forward/backward movement cam to advance toward and over an opposing needle bed when seen from above, and wherein a swing locus control means is provided for swinging said loop retainer when said loop presser is moved forward/backward, and comprising:

shifting said yarn feeder beyond a knitting width of a knitted fabric and knitting a first stitch course, after that, before knitting a second stitch course, making a loop presser located immediately outside of a first stitch loop of said second stitch course move forward into the trick gap for pressing down and retaining a yarn extending from said first stitch course to the yarn feeder by the loop retainer of said advanced loop presser;

after that, shifting said yarn feeder above said knitting width for winding said yarn around said loop retainer; and next, after forming at least the first stitch loop of said second stitch course, making said loop presser move backward from the trick gap and releasing said yarn from said loop retainer.

* * * * *